US010690019B2

(12) United States Patent
Wing et al.

(10) Patent No.: US 10,690,019 B2
(45) Date of Patent: Jun. 23, 2020

(54) ZERO PRESSURE UNLOCKING SYSTEM FOR A PHASER

(71) Applicant: BorgWarner Inc., Auburn Hills, MI (US)

(72) Inventors: Braman Wing, Ithaca, NY (US); Mark M. Wigsten, Lansing, NY (US); Chad McCloy, Cortland, NY (US); Chris Pluta, Lansing, NY (US); Jonas Adler, Ithaca, NY (US); Jason Moss, Spencer, NY (US); Keith Feldt, Ithaca, NY (US)

(73) Assignee: BorgWarner Inc., Auburn Mills, MI (US)

( * ) Notice: Subject to any disclaimer, the term of this patent is extended or adjusted under 35 U.S.C. 154(b) by 0 days.

(21) Appl. No.: 16/293,766

(22) Filed: Mar. 6, 2019

(65) Prior Publication Data

US 2019/0277167 A1 Sep. 12, 2019

Related U.S. Application Data

(60) Provisional application No. 62/639,688, filed on Mar. 7, 2018.

(51) Int. Cl.
*F01L 1/344* (2006.01)

(52) U.S. Cl.
CPC ... *F01L 1/3442* (2013.01); *F01L 2001/34433* (2013.01); *F01L 2001/34456* (2013.01); *F01L 2001/34473* (2013.01); *F01L 2001/34479* (2013.01); *F01L 2250/02* (2013.01); *F01L 2250/04* (2013.01); *F01L 2250/06* (2013.01); *F01L 2800/01* (2013.01); *F01L 2820/01* (2013.01)

(58) Field of Classification Search
CPC ..... F01L 1/3442; F01L 2001/34423; F01L 2001/34426; F01L 2001/3443; F01L 2001/34433; F01L 2001/34446; F01L 2001/34453; F01L 2001/34469; F01L 2800/01; F01L 2800/05; F01L 2800/16
USPC ..... 123/90.15
See application file for complete search history.

(56) References Cited

U.S. PATENT DOCUMENTS

| | | | | |
|---|---|---|---|---|
| 6,883,479 | B2 | 4/2005 | Simpson | |
| 9,127,575 | B2 | 9/2015 | Fischer et al. | |
| 2007/0056538 | A1 | 3/2007 | Simpson et al. | |
| 2009/0056656 | A1 * | 3/2009 | Strauss | F01L 1/3442 123/90.17 |

* cited by examiner

*Primary Examiner* — Jorge L Leon, Jr.
(74) *Attorney, Agent, or Firm* — Brown & Michaels, PC

(57) ABSTRACT

Using existing phaser control valve and a solenoid to create a pumping chamber which provides enough oil pressure to disengage a locking pin at all conditions.

22 Claims, 20 Drawing Sheets

ZERO PRESSURE UNLOCKING SYSTEM FOR A PHASER

CROSS-REFERENCE TO RELATED APPLICATIONS

This application claims the benefit of U.S. Patent Application No. 62/639,688 filed on Mar. 7, 2018, the disclosure of which is herein incorporated by reference in its entirety.

BACKGROUND

The invention pertains to the field of variable cam timing phasers. More particularly, the invention pertains to a zero pressure unlocking system for a variable cam timing phaser.

DESCRIPTION OF RELATED ART

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft, (or camshafts, in a multiple-camshaft engine). Vane phasers have a rotor with one or more vanes, mounted to the end of the camshaft, surrounded by a housing assembly with the vane chambers into which the vanes fit. It is possible to have the vanes mounted to the housing assembly, and the chambers in the rotor assembly, as well. The housing's outer circumference forms the sprocket, pulley or gear accepting drive force through a chain, belt, or gears, usually from the crankshaft, or possibly from another camshaft in a multiple-cam engine.

In cam torque actuated (CTA) variable camshaft timing (VCT) systems, cam torques from the engine are used to move the one or more vanes and fluid is recirculated between the working chambers without exhausting the fluid to sump. A lock pin for locking and unlocking the movement between the housing assembly and the rotor assembly can be controlled by a control valve. During engine shutdown, the control valve is moved to a position such that fluid is maintained within the chambers via recirculation, and any fluid feeding to the lock pin is vented from the circuit through the control valve.

During engine cranking or shortly thereafter, there may not be sufficient oil pressure to release the lock pin because the engine's oil passages, including those leading to the phaser may have drained. Time is required for the oil pump, which is driven by the rotation of the engine, to re-till and build pressure in the engine's oil circuit.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated. VCT systems, an oil control valve (OCV) directs engine oil pressure to one working chamber in the VCT phaser while simultaneously venting the opposing working chamber defined by the housing assembly, the rotor assembly, and the vane. This creates a pressure differential across one or more of the vanes to hydraulically push the VCT phaser in one direction or the other. Neutralizing or moving the oil control valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) systems operate under a similar principle with the exception that they have one or more check valves to prevent the VCT phaser from moving in a direction opposite than being commanded, should it incur an opposing force such as a torque impulse caused by cam operation.

The problem with OPA or TA systems in executing the operations discussed above is that the oil control valve defaults to a position that exhausts all the oil from either the advance or retard working chambers and fills the opposing chamber. In this mode, the phaser defaults to moving in one direction to an extreme stop where the lock pin engages. A bias spring may be used to preferentially guide the phaser to a desired position. The OPA or TA systems are unable to direct the VCT phaser to any other position during the engine start cycle when the engine is not developing any oil pressure and cannot unlock the lock pin.

Some vehicles can use a "stop-start mode" which automatically stops and automatically restarts the internal combustion engine to reduce the amount of time the engine spends idling when the vehicle is stopped, for example at a stop light or while sitting in traffic. This mode reduces emissions and increases fuel efficiency. This stopping of the engine is different than a "key-off" position or manual stop via deactivation of the ignition switch in which the user of the vehicle shuts the engine down or puts the car in park and shuts the vehicle off. In "stop-start mode," the engine stops as the vehicle is stopped, then automatically restarts in a manner that is nearly undetectable to the user of the vehicle. During "stop-start," it has been determined that the full retard phaser position reduces the energy required to start the engine and reduces the engine Noise Vibration and Harshness (NVH) during a hot engine restart. Other strategies may be developed that require a different lock position than described.

The problem with an intake camshaft phaser design that has an extended range of authority and the ability to lock at the full retard stop is that if the engine is shut down with the intake camshaft phaser locked at or near the retard stop and the engine is allowed to cool down, then the engine may not be able to accomplish a successful cold start with the phaser locked near the retard stop. During engine cranking there may not be sufficient engine oil pressure to release the lock pin.

SUMMARY OF THE INVENTION

Using an existing phaser control valve and a solenoid to create a pumping chamber which provides enough oil pressure to disengage a locking pin at all conditions.

DETAILED DESCRIPTION

FIGS. 1-10B show the operating modes the VCT phaser depending on the spool valve position. The positions shown in the figures define the direction in which the VCT phaser is moving. It is understood that the phase control valve has an infinite number of intermediate positions, so that the control valve not only controls the direction in which the VCT phaser moves but, depending on the discrete spool position, controls the rate at which the VCT phaser changes positions. Therefore, it is understood that the phase control valve can also operate in infinite intermediate positions, and is not limited to the positions shown in the Figures.

Figure 5:
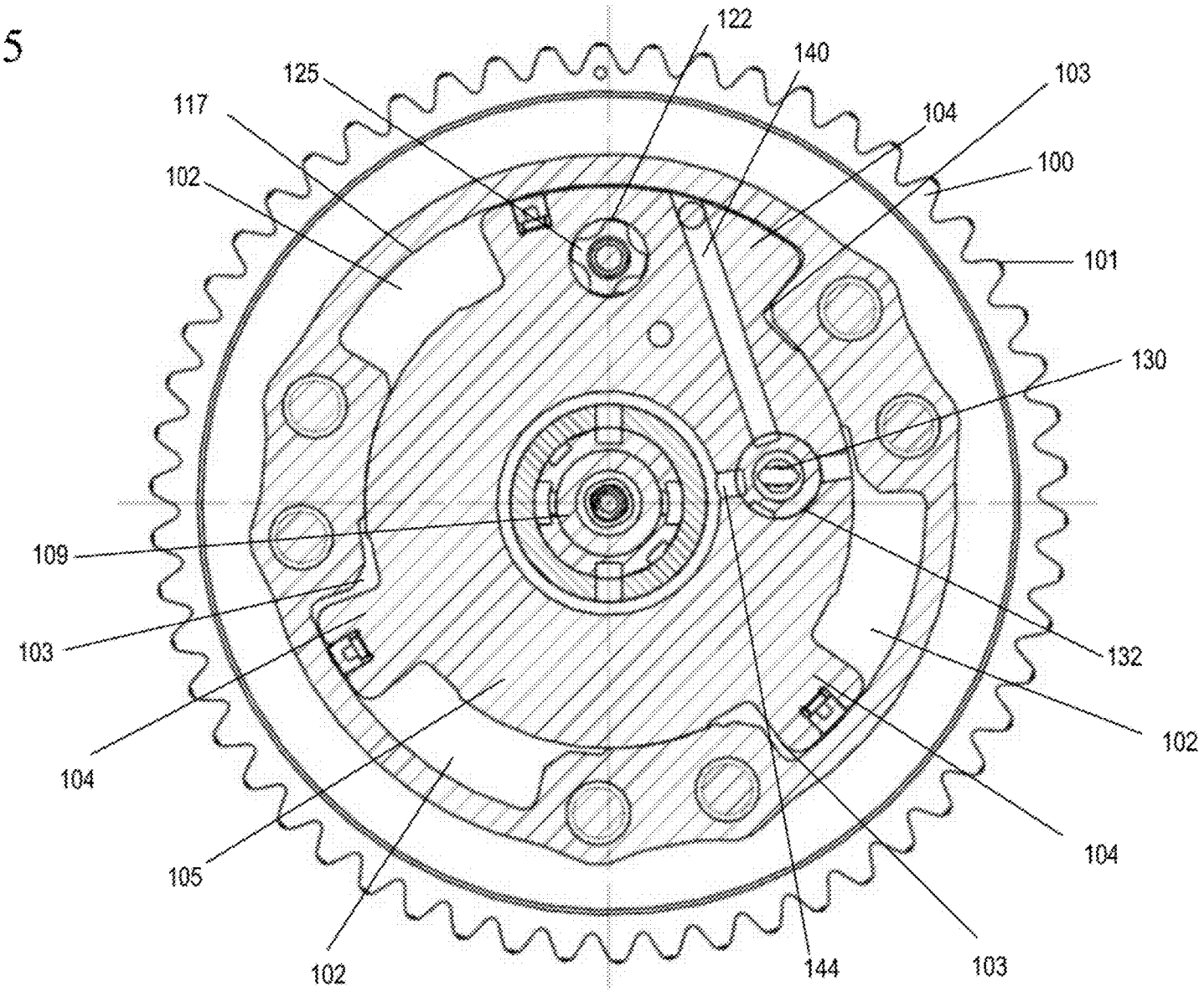
FIG. 5 shows a sectional view of the variable cam timing phaser showing the rotor assembly and the pilot valve.

Referring to FIG. 5, the housing assembly 100 of the phaser has an outer circumference 101 for accepting a drive force. The housing assembly 100 of the phaser includes an inner face plate 100*a* and an outer face plate 100*b*. The rotor assembly 105 is connected to the camshaft (not shown) and is coaxially located within the housing assembly 100. The rotor assembly 105 has at least one vane 104 separating a chamber 117 formed between the housing assembly 100 and the rotor assembly 105 into working chambers such as an advance chamber 102 and a retard chamber 103. The vane 104 is capable of rotation to shift the relative angular position of the housing assembly 100 and the rotor assembly 105.

The inner face plate 100*a* of the housing, assembly 100 may include an end plate pocket 155 connected to a vent 128 leading to sump. The rotor assembly 105 has a corresponding rotor pocket 157, which when aligned with the end plate pocket 155, allows the venting of a control valve 109, preventing lock up. The vent 128 is shown in FIGS. 9A, 9B, 10A and 10B as an orifice, however, the vent 128 can be a worm trail or other restricted orifice.

Figure 6:
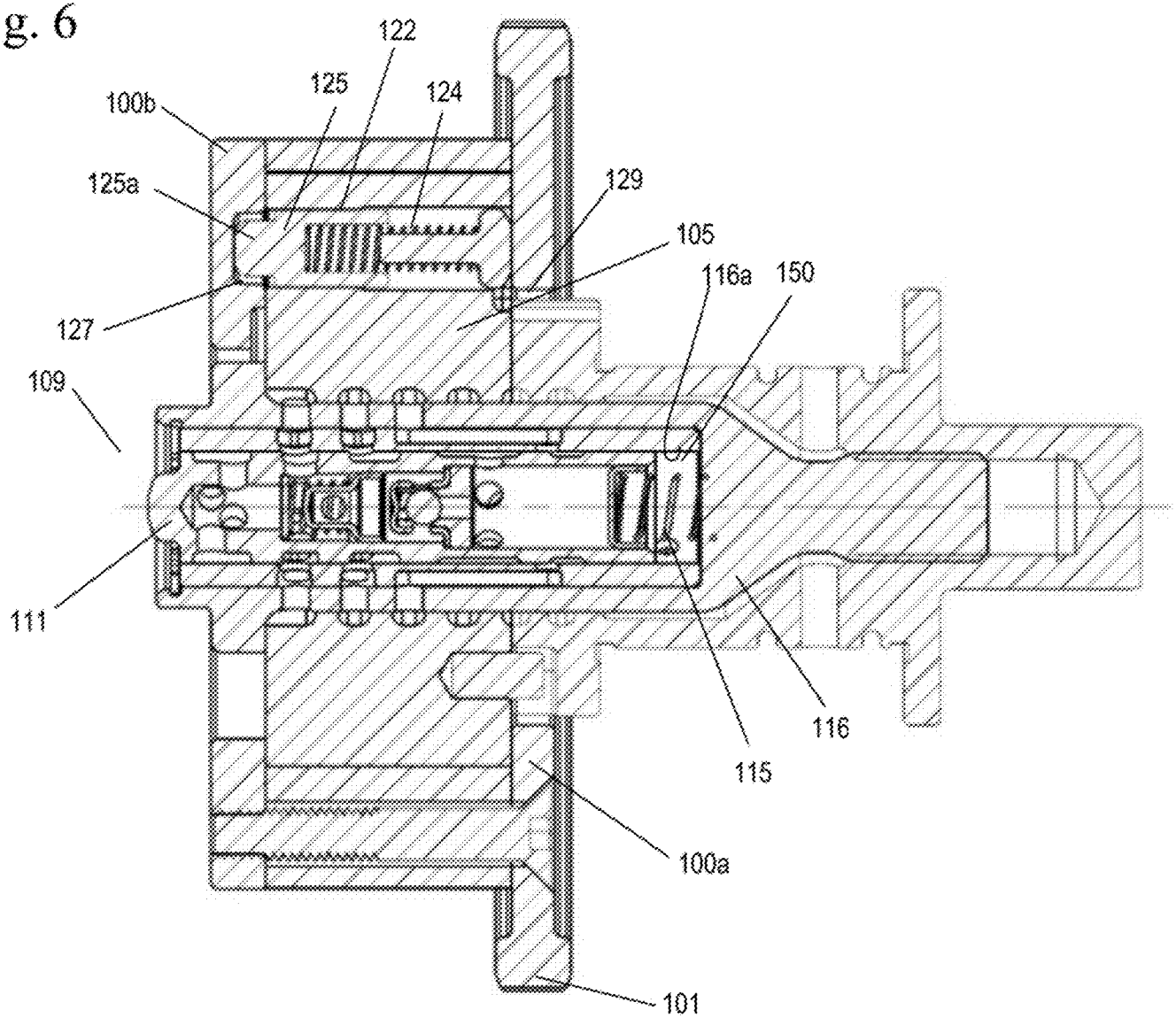
FIG. 6 shows a sectional view of the variable cam timing phaser showing the control valve and the lock pin.
Figure 7:
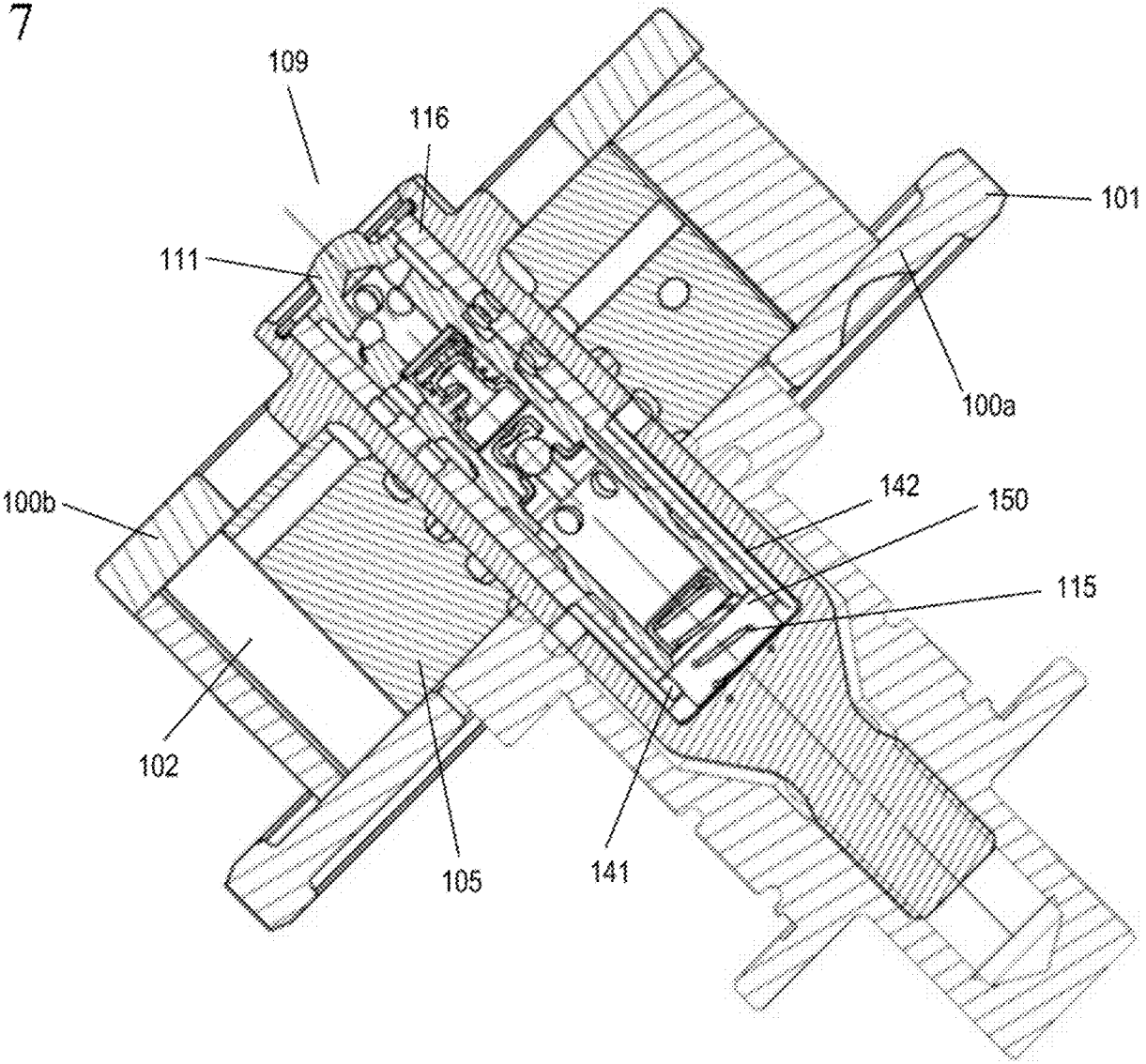
FIG. 7 shows another sectional view of the variable cam timing phaser showing the control valve and the passage from the pump chamber in the spool to the pilot valve.
Figure 8:
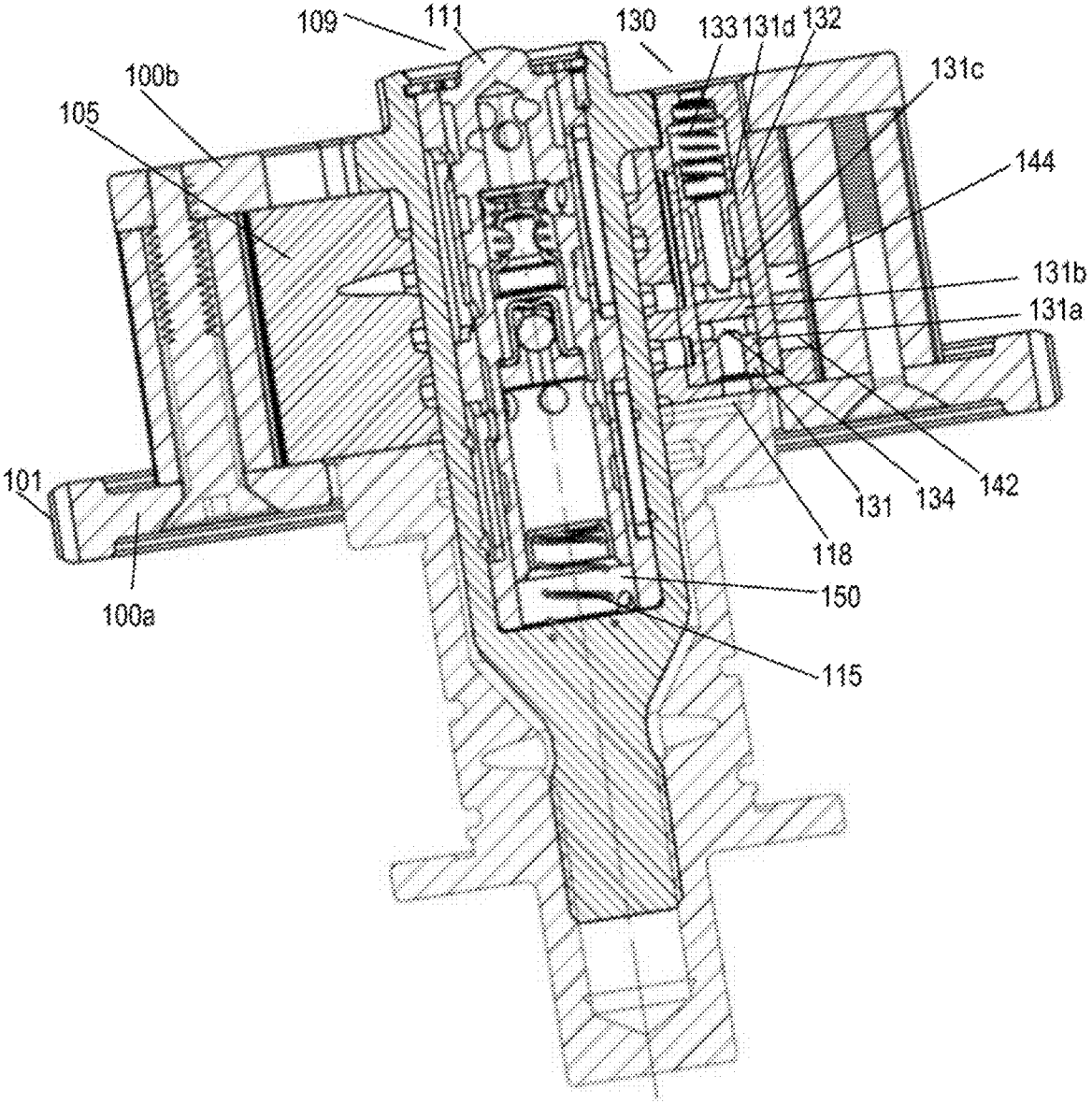
FIG. 8 shows another sectional view of the variable cam timing phaser showing the control valve and pilot valve.
Figure 9A:
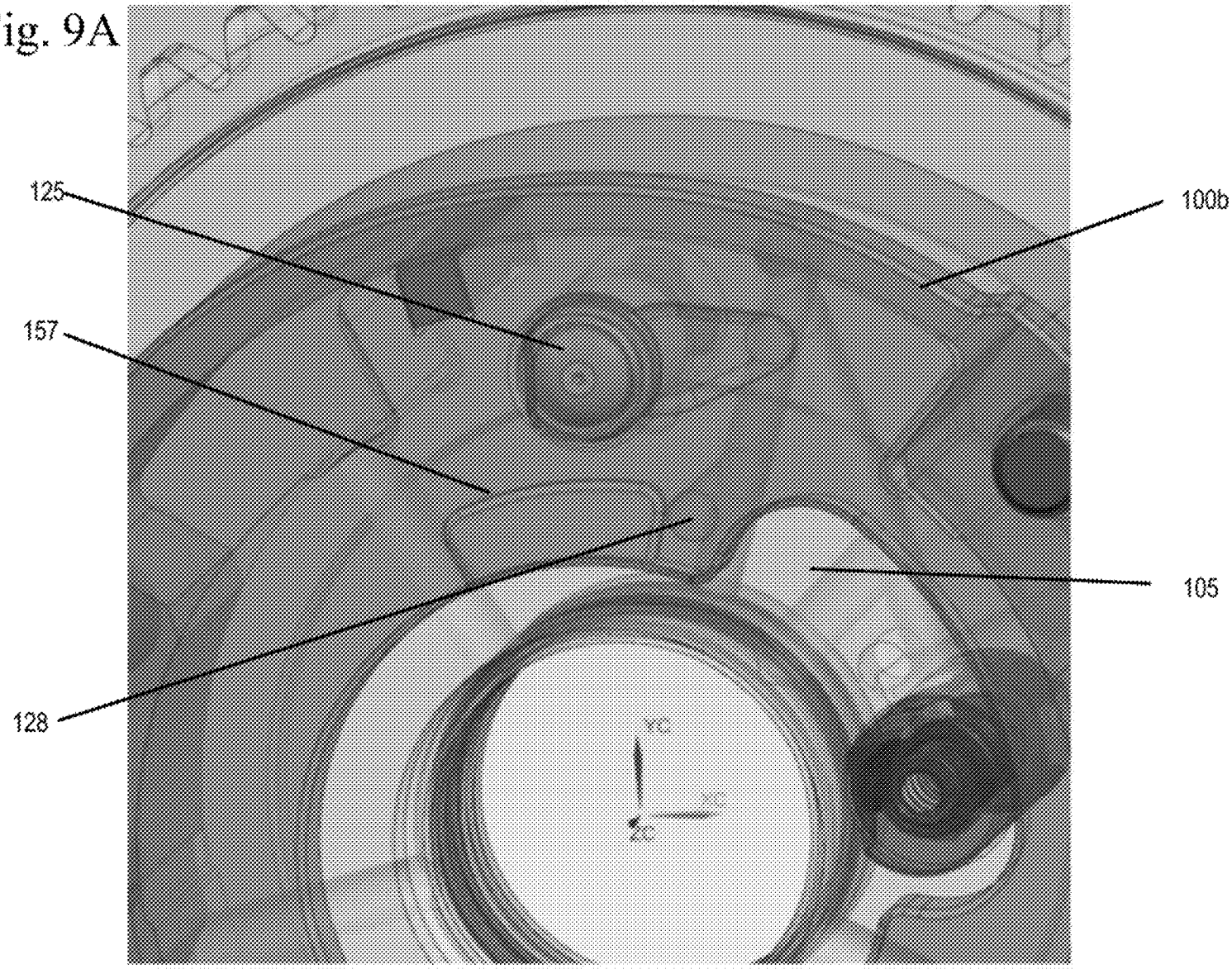
FIG. 9A shows an enlarged view of the locked position with the vent feature on the end plate closed.
Figure 9B:
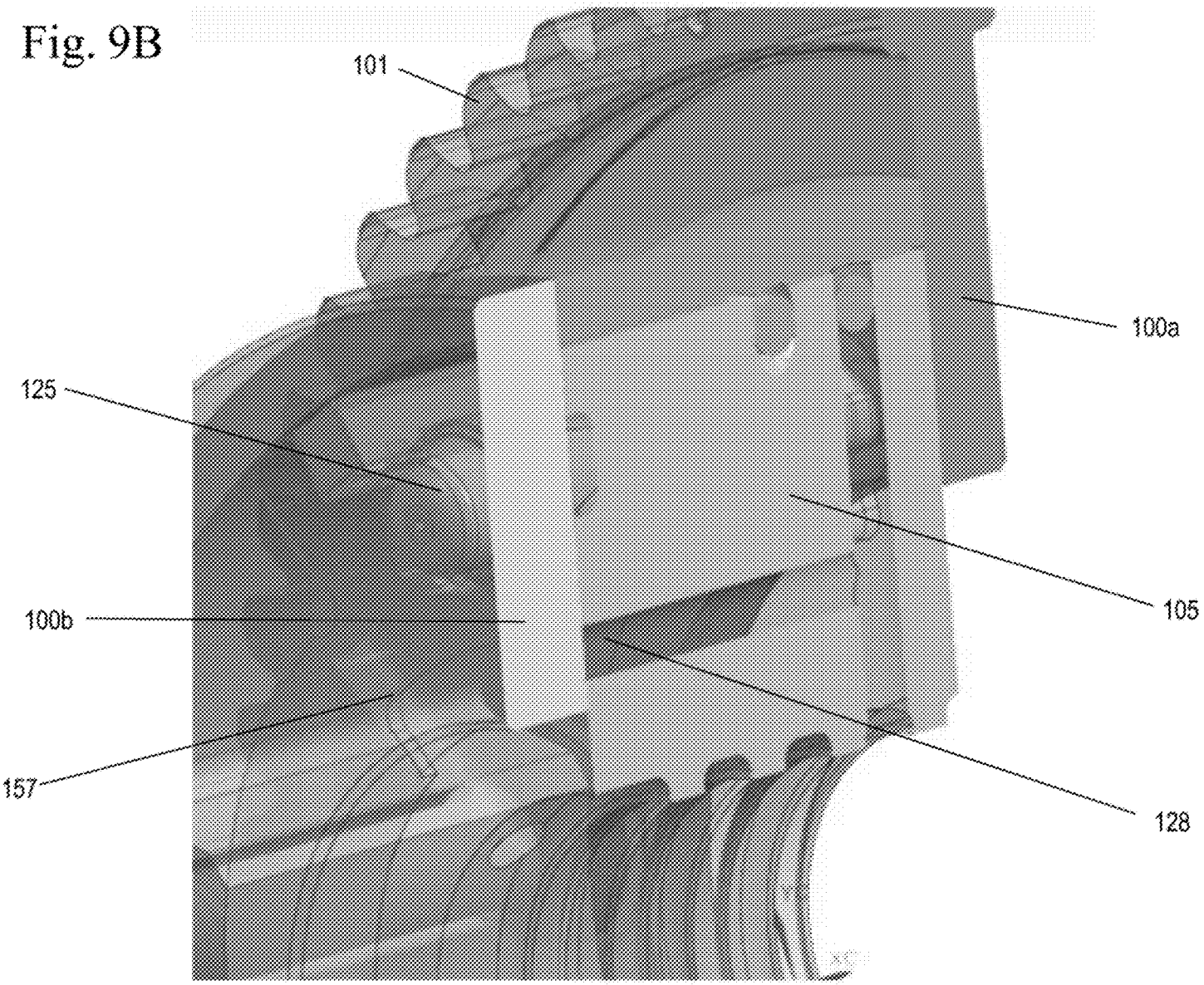
FIG. 9B shows another enlarged view of the locked position with the vent feature on the end plate closed.
Figure 10A:
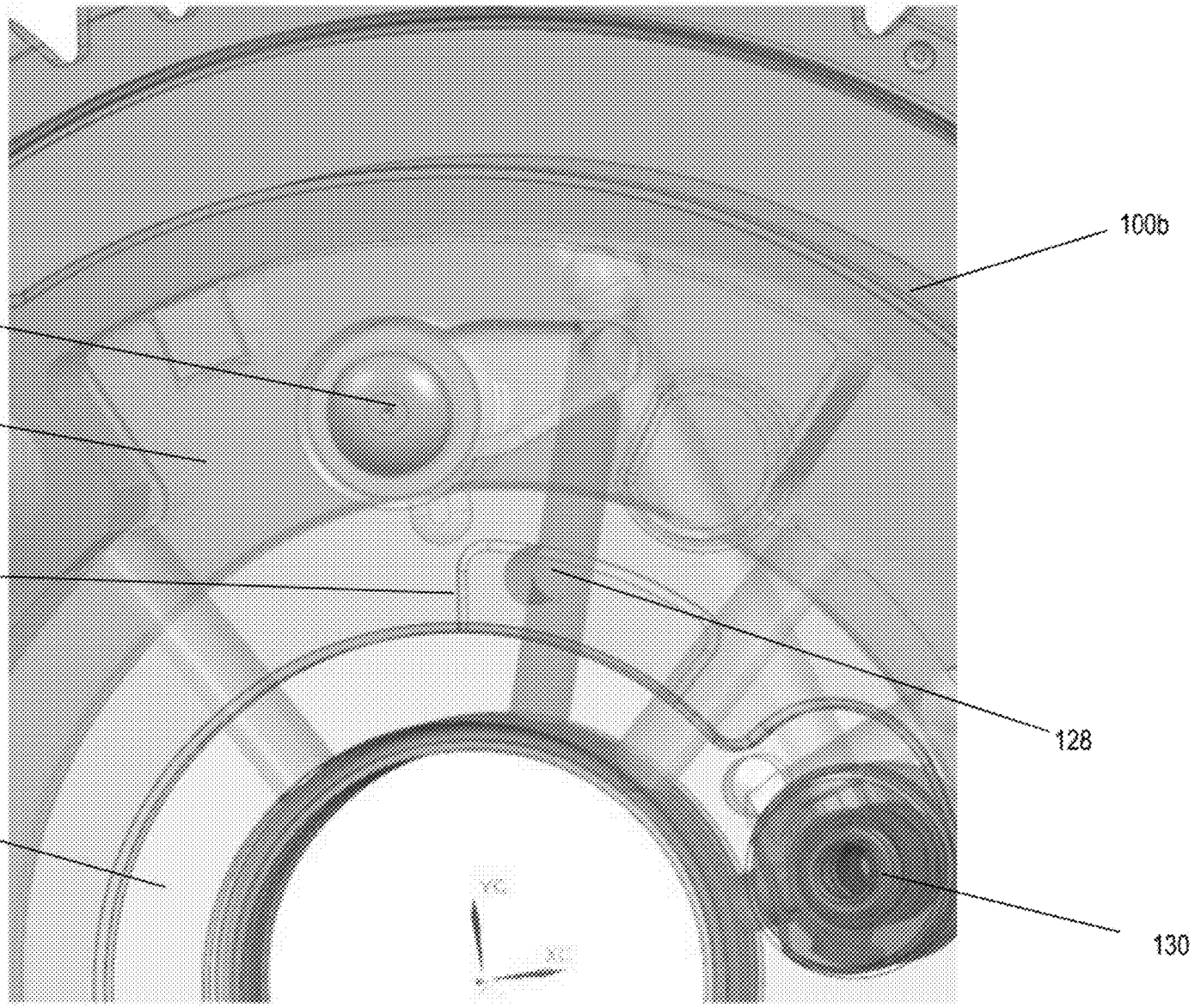
FIG. 10A shows an enlarged view of the unlocked position with the vent feature on the end plate open.
Figure 10B:
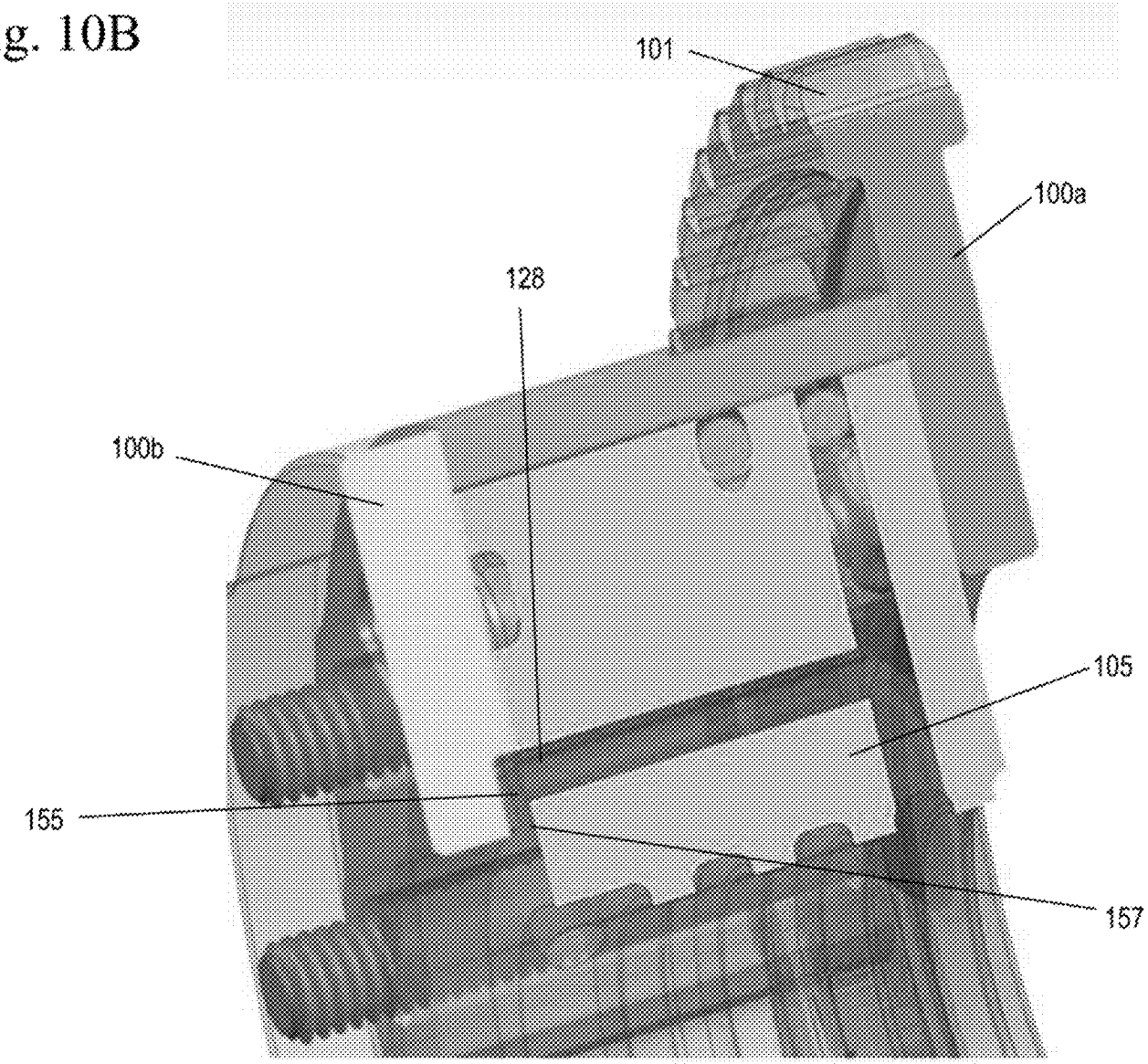
FIG. 10B shows another enlarged view of the unlocked position with the vent feature on the end plate open.

A lock pin 125 is slidably housed in a bore 122 in the rotor assembly 105 and has an end portion 125*a* that is biased towards and fits into a recess 127 in the inner plate 100*b* of the housing assembly 100 by a spring 124, for example as shown in FIG. 6. Alternatively, the lock pin 125 may be housed in the housing assembly 100 and be spring 124 biased towards a recess 127 in the rotor assembly 105. The outer end plate 100*b* may include a vent 129, for example a worm trail or other restricted orifice which allows the lock pin 125 to vent and prevents hydraulic lock of the lock pin 125.

The lock pin 125 has a first, unlocked position in which the end portion 125*a* of the lock pin 125 does not engage the recess 127 and a second, locked position in which the end portion 125*a* of the lock pin 125 engages the recess 127, locking the relative movement of the rotor assembly 105 relative to the housing assembly 100. The recess 127 is in fluid communication with the phase control valve 109 via a pilot valve 130. The pressurization of the lock pin 125 is controlled by the switching/movement of the phase control valve 109 and the pilot valve 130.

Referring to FIGS. 1-4 and 5-8, a phase control valve 109, preferably a spool valve, includes a spool 111 with at least one cylindrical land 111*a* is slidably received in a sleeve 116 within a bore in the rotor assembly 105 and pilots in the camshaft (not shown). The phase control valve 109 may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators. Between the end of the spool 111 which contacts the spring 115 and the inner diameter 116*a* of the sleeve 116 is formed a pump chamber 150. The pump chamber 150 stores supply oil and the pressure of the oil in this chamber 150 is pumped up or increased in pressure by the movement of the pilot valve 130 and the spool 111.

The position of the phase control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output; ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as what fluid is used to lock or unlock the lock pin.

A pilot valve 130, preferably a spool valve, includes a spool 131 with cylindrical lands 131*a*, 131*b*, 131*c*, 131*d* slidably received in a sleeve 132 within a bore in the rotor assembly 105. A through passage 134 is present between lands 131*a* and 131*b*. The pilot valve 130 may be located remotely from the phaser, or within a bore in the rotor assembly 105 which pilots in the camshaft (not shown). One end of the spool 131 contacts spring 133 and the opposite end of the spool 131 is in fluid communication with supply S through line 118. The supply line 118 may contain an inlet check valve 119 allowing for the flow of fluid into supply line 118 and preventing the flow of fluid out of supply line 118. The pilot valve 130 is in fluid communication with the phase control valve 109 through lines 141 and 142 as well as with the recess 127 of the housing assembly 100 through line 140. The pilot valve 130 additionally is in fluid communication with a supply line 144. Supply line 144 is preferably in fluid communication with supply S. Supply 144 could be in fluid communication directly with line 118 or in communication selectively through the spool valve 109. Alternatively, supply 144 could be controlled by the advance chamber 102 or the retard chamber 103. A vent port 145 is also present within the sleeve 132.

The position of the spool 131 is influenced by spring 115 and the variable force solenoid 107. The position of the spool 111 controls what fluid is used to unlock or lock the lock pin 125 and whether supply oil is provided to a pump chamber 150 present between the spool 111 and the sleeve 116. The pilot valve 130 has two positions. In a first position of the pilot valve 130, spool land 131*d* blocks the flow of supply line 144 and in a second position in which supply line 144 is open to supply S and line 141 is blocked by spool land 131*a*.

A spool controlled lock pin circuit is comprised of a supply line 144 in fluid communication with the pilot valve 130, the pilot valve 130, line 140 in fluid communication with the recess 127 of the housing assembly 100 and the lock pin 125. When the engine is oft the lock pin 125 is in the locked position.

A pump chamber circuit is comprised of a supply line 118 in fluid communication with the pilot valve 130, the pilot valve 130, line 141 in fluid communication with the pilot valve 130 and the pump chamber 150, line 142 in fluid communication with pump chamber 150 and the pilot valve 130. The pump chamber 150 fills by decaying oil pressure and fluid venting from the lock pin 125 until either the pressure is no longer sufficient to force fluid into the pump chamber 150 or the pump chamber 150 is full. Therefore, the pump chamber 150 is filled as engine oil pressure drops.

The pump chamber circuit is filled during engine off. All fluid present in the phaser itself, with the exceptions of the advance and retard chambers of a CTA phaser, drain back into the pump chamber 150. Residual pressure from the oil system fills the pump chamber circuit until either the pressure is no longer sufficient to force fluid into the pump chamber 150 or the pump chamber 150 is full.

Typically, during engine cranking, after an engine shutdown, there is no oil pressure present to unlock the lock pin 125 and no phasing can begin until after the lock pin 125 has been pressure biased to an unlocked position. In the present invention, during engine cranking and/or start-up, after engine shutdown, the lock pin 125 is moved to an unlocked position when the pump chamber circuit is in fluid communication with the spool controlled lock pin circuit. In other words, when fluid moves from the pump chamber 150, through line 142, between spool lands 131*c* and 131*d* of the pilot valve 130 to the recess 127 through line 140, the lock pin 125 is moved against the force of the spring 124, such that the end 125*a* of the lock pin 125 no longer engages the recess 127.

Once the end 125*a* of the lock pin 125 has disengaged from the recess 127, the rotor assembly 105 can be moved relative to the housing assembly 100 and the phaser can be phased, for example to a retard position, an intermediate position, an advance position and in some phasers a detent position. Fluid is supplied to the recess 127 of the lock pin 125 to maintain the lock pin 125 in the unlocked position from supply line 144 when supply pressure is present and the phaser is phasing. At this point, no fluid is being maintained in the pump chamber 150. Should the pump circuit not be used to unlock the phaser the spool 111 can perform its normal function of unlocking the phaser after oil pressure reaches an operating level because the pilot valve 130 will have moved up to vent the pump chamber 150 and connect passage 144 to passage 140.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, and the lock pin 125 will be pressurized and released.

Figure 1:
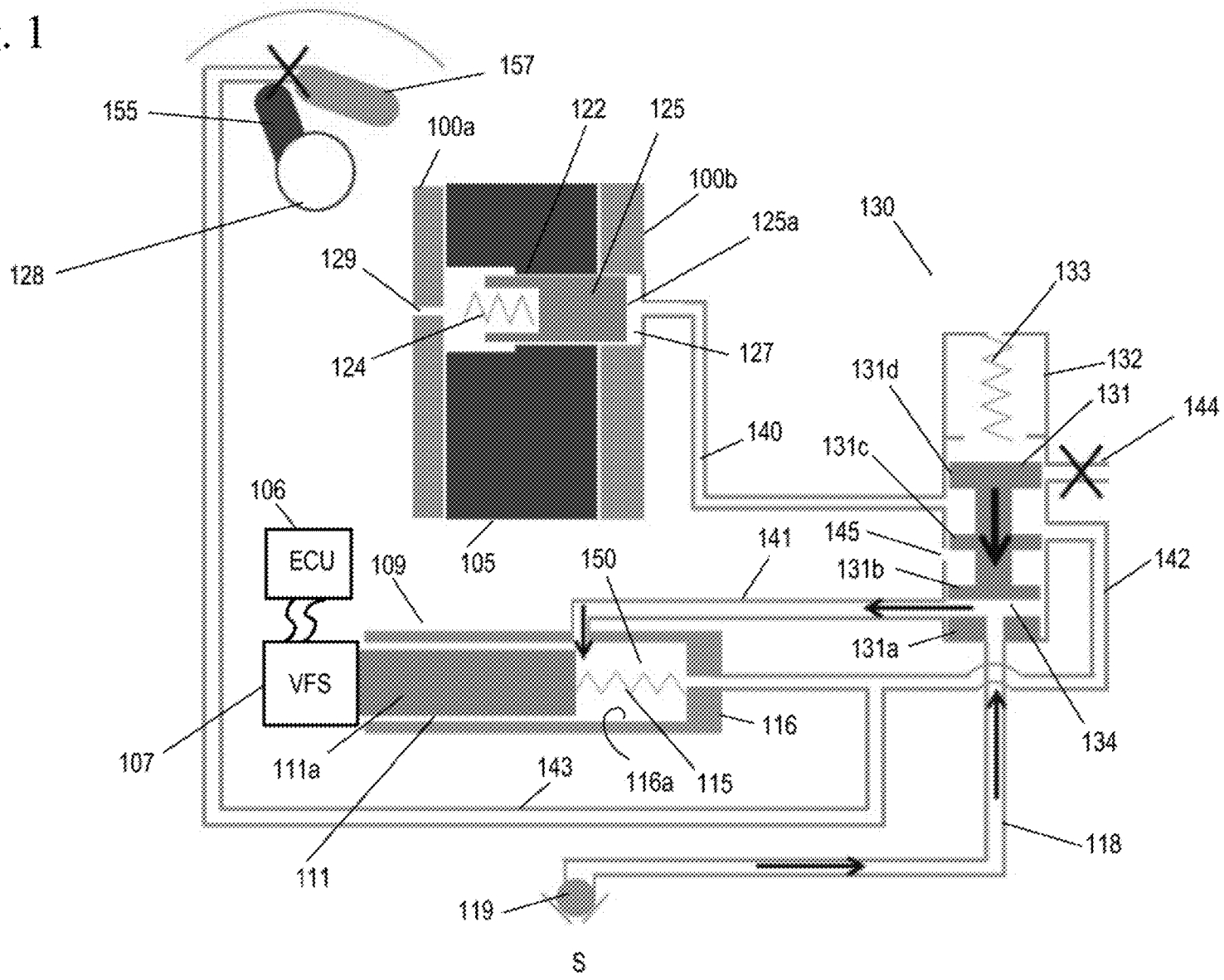
FIG. 1 shows a schematic of a variable cam timing phaser of an embodiment during shutdown of the phaser and filling of the spool chamber.

Referring to FIG. 1, when the duty cycle of the variable force solenoid 107 is 0%, the spool 111 of the phase control valve 109 is moved to a position by the spring 115, such that the pump chamber 150 receives any fluid present in the supply line 118 through the pilot valve 130 between lands 131*a* and 131*b* via line 141. Since the pressure of the fluid from supply S is below a threshold, due to engine shutdown, spring 133 biases the spool 131 of the pilot valve 130 to a position such that the supply 144 is blocked from supplying fluid to the lock pin 125 via line 140. Any fluid present in line 140 can drain to the pump chamber 150 via the pilot valve 130 and line 142. Due to the absence of fluid pressure in line 140, the lock pin 125 is biased by spring 124 to engage recess 127 and lock the relative movement of rotor assembly 105 relative to the housing assembly 100. The filling of the pump chamber 150 is essentially priming the phase control valve 109 to act as a pump. The volume of fluid, which aggregates in the fluid chamber 150, is preferably a volume in which would be required to unlock the lock pin 125, with provisions for leakage. The rotor pocket 157 is not aligned with the end plate pocket 155 and vent 128 is blocked.

Figure 2:
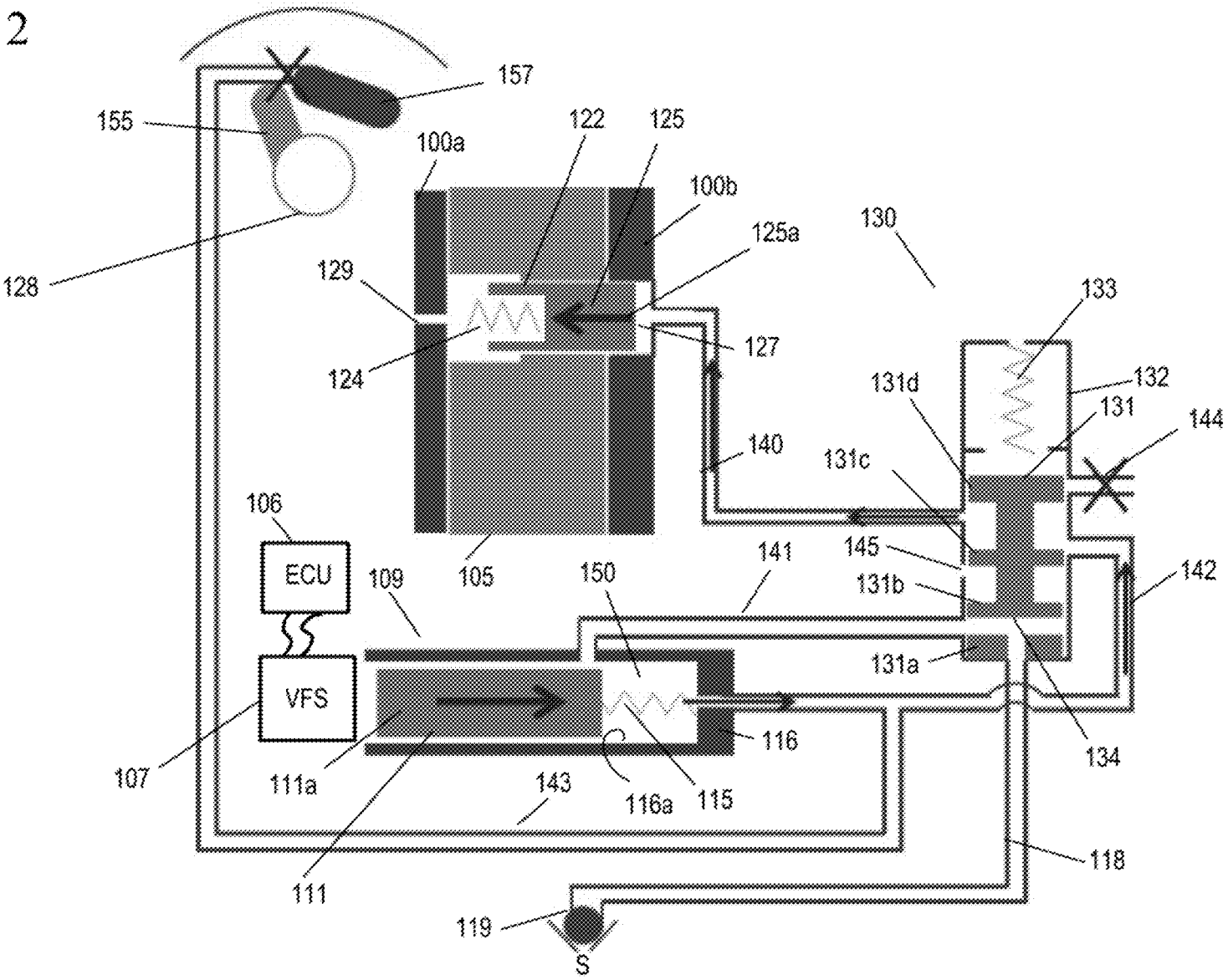
FIG. 2 shows a schematic of a variable cam timing phaser of an embodiment during operation of the spool pump.

FIG. 2 shows a schematic of a variable cam timing phaser of an embodiment during operation of the spool pump at engine cranking. During engine cranking there is very little to no pressure present due to the lack of supply oil pressure. Since no supply pressure is present both from supply line 118 and from line 144, there is no pressure present to unlock the lock pin 125 and thus phase the phaser soon after engine or during engine cranking.

During engine cranking, the spool 111 of the phase control valve 109 is moved to a position by the VFS 107, against the force of the spring 115, such that the spool 111 blocks the flow of fluid to the pump chamber 150 via line 141. During engine cranking, in order to pump the fluid from the pump chamber 150, the duty cycle starts at 0% and moves to 100%, to force the phase control valve 109 to expel the fluid present in the pump chamber 150 and exhaust from the pump chamber 150 into line 142, since line 141 is blocked. The movement of the spool by the VFS 107 against the force of the spring 115 creates pressure in the pump chamber 150, pumping or forcing the fluid into line 142 at a high pressure. From line 142, fluid flows between lands 131*c* and 131*d* of the pilot valve 130 to line 140 in fluid communication with the recess 127 in the housing assembly 100, biasing the lock pin 125 against the spring 124 toward an unlocked position. The rotor pocket 157 is not aligned with the end plate pocket 155 and vent 128 is blocked.

Figure 3:
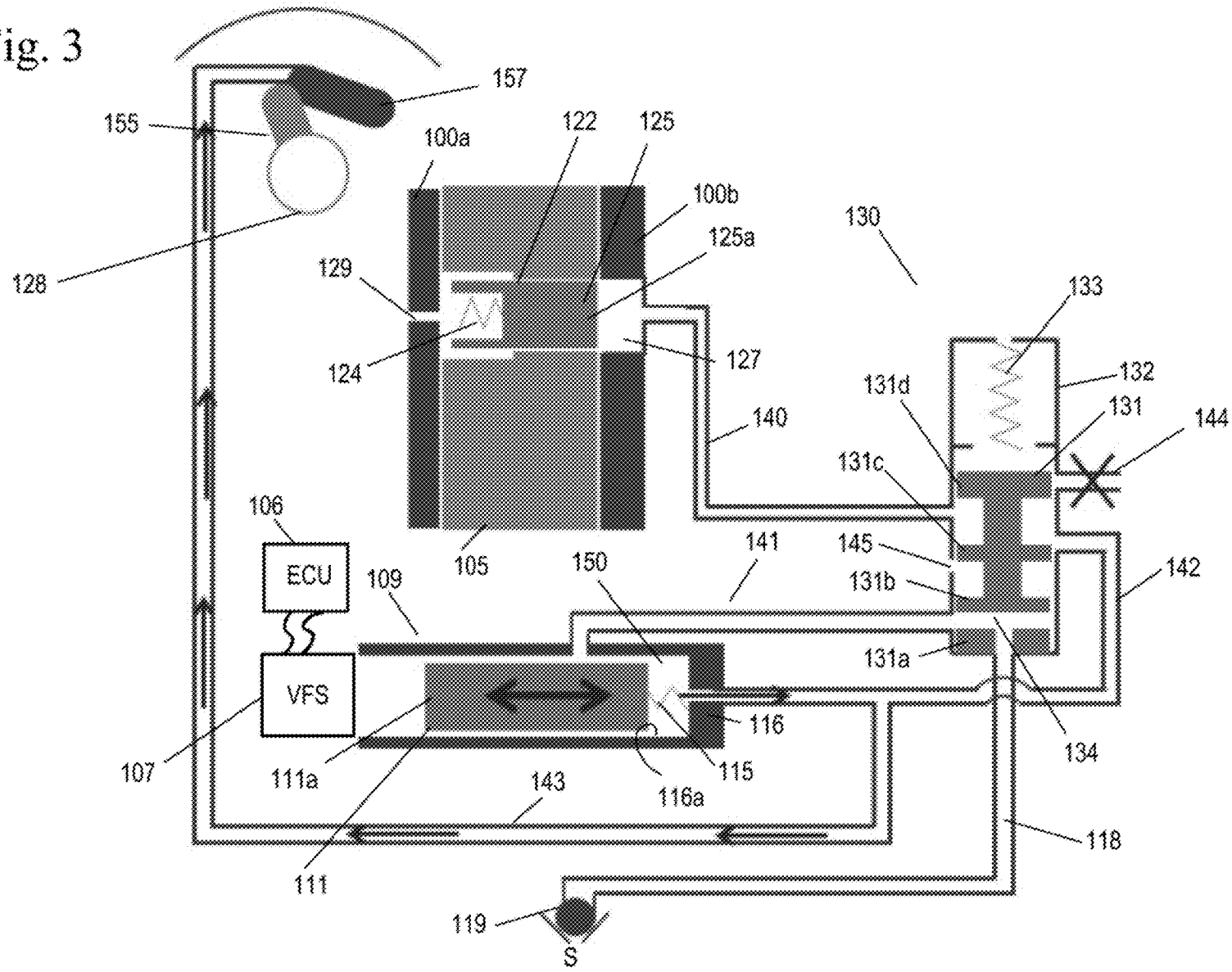
FIG. 3 shows a schematic of a variable cam timing phaser of an embodiment during venting of the pump circuit once the phaser has been phased away from a locked position.

FIG. 3 shows the phaser during engine cranking, but after the lock pin 125 has been moved to an unlocked position. It should be noted that the duty cycle is moved to whatever cycle is necessary for a target phasing of the variable cam timing phaser. After the lock pin 125 has been unlocked and no longer engages the recess 127 of the housing assembly 100, the rotor assembly 105 is free to rotate. Fluid exiting the pump chamber 150 exhausts to line 143 in communication with the vent 128, as the rotor pocket 157 is aligned with the end plate pocket 155, allowing the spool 111 to move and prevent lockup and allow the phaser to phase. Supply 144 is blocked from supplying fluid to the lock pin 125 by land 131*d* of the pilot valve 130 and so that fluid is not allowed to travel back to supply 144. It should be noted that supply 144 is blocked, as the fluid pressure in supply line 118 is not adequate to bias the pilot valve 130 to a second position against spring 133 (e.g. the oil pressure has not reached a threshold).

Figure 4:
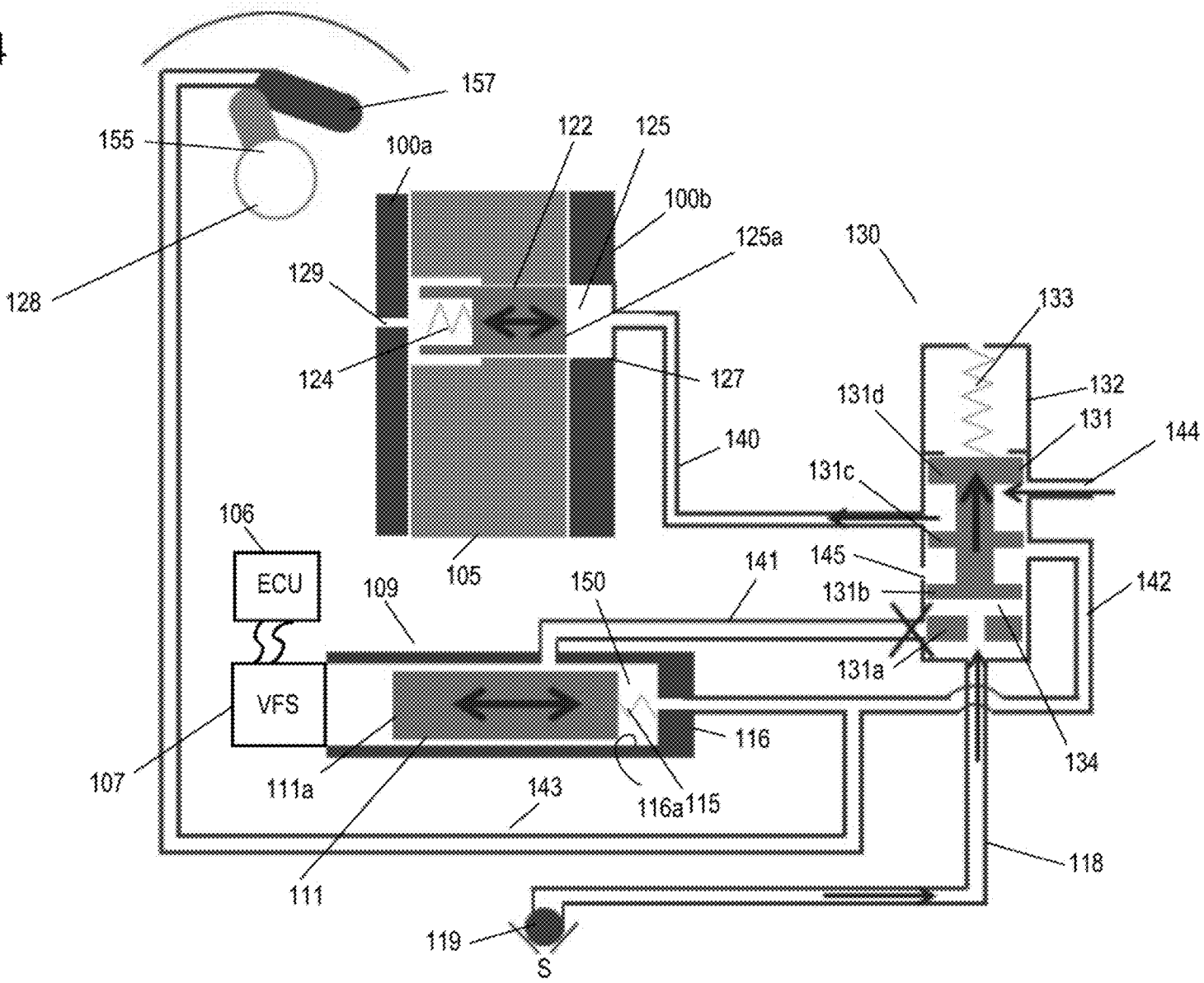
FIG. 4 shows a schematic of a variable cam tuning phaser of an embodiment during normal operation once the engine is running and oil pressure has reached a threshold.

FIG. 4 shows a schematic of a variable cam timing phaser of an embodiment during normal operation once the engine is running and oil pressure has reached a threshold. Once the oil pressure in line 118 reaches a pressure in which it can bias the spool 131 against the spring 133, the spool 131 is moved to a second position in which spool land 131*a* blocks line 141. Any fluid present in the pump chamber 150 of the phase control valve 109 is incidental and vents through vent 145 of the pilot valve 130. Fluid is also supplied from supply 144, through the pilot valve 130 between spool lands 131*c* and 131*d* to line 140, maintaining the lock pin 125 in an unlocked position and biasing the lock pin 125 against the spring 124. It should be noted that the lock pin 125 may remain in an unlocked state without fluid from supply 144 until the lock pin 125 is aligned with the recess 127. Normal engine operation may take place and the lock pin 125 may be moved to an unlocked position, and a locked position per engine operation conditions. Furthermore, the rotor pocket 157 is aligned with the end plate pocket 155 and vent 128 is open.

Figure 11:
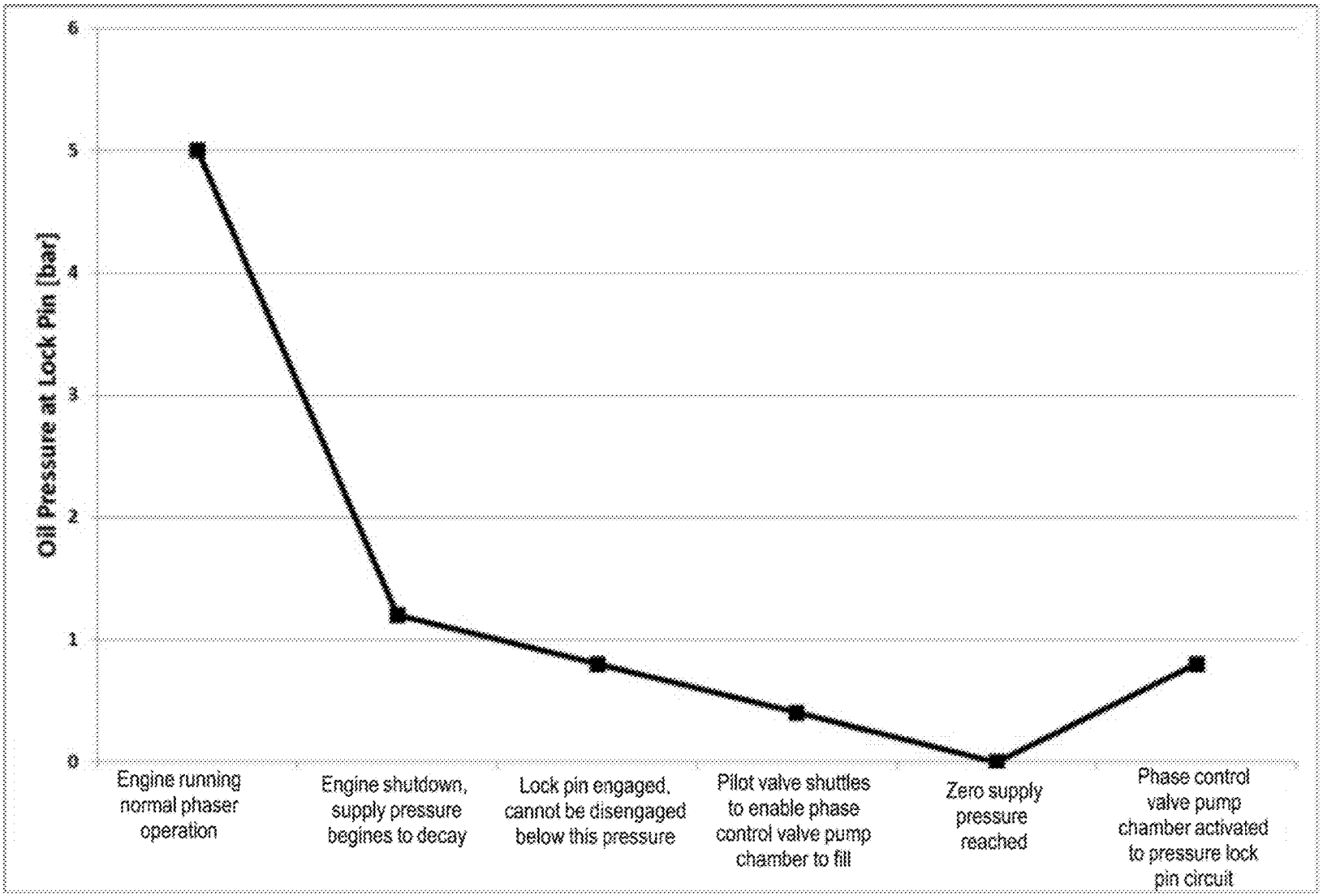
FIG. 11 shows a graph of pressure versus position.

FIG. 11 is a graph of an example of pressure versus position. During normal engine phaser operation, for example as shown in FIG. 4, the oil pressure at the lock pin 125 may be approximately 5 bar. As then engine shuts down, as shown in FIG. 1, engine oil pressure at the lock pin 125 begins to decay, or drops, for example to approximately 1.25 bar. The lock pin 125 is locked or is engaged with the recess 127 and cannot be disengaged or unlocked below approximately 0.8 bar (i.e. the spring 124 has a force that is greater than the force of the pressure on the lock pin 125). The pilot valve 130 moves to enable the pump chamber 150 to fill at approximately 0.4 bar. When the oil pressure at the lock pin 125 is at zero bar, no additional oil is supplied to the pump chamber 150.

During engine cranking on restart, the spool 111 is moved by the VFS 107, such that the volume of oil in the pump chamber 150 is pressurized to greater than 0.8 bar and expelled to activate and pressurize the spool controlled lock pin circuit, as shown in FIG. 2. It should be rioted that the pressures given in FIG. 11 are for example purposes and may vary during engine operation.

While the embodiments described above contain a single pilot valve 130 of a length, the pilot valve 130 can be split into at least two pilot valves of a length that is less than the length of the single pilot valve 130, reducing the axial package space required for the phaser.

FIGS. 12-18 show the operating modes the VCT phaser based on different engine operating conditions. The positions shown in the figures define the direction in which the VCT phaser is moving. It is understood that the phase control valve has an infinite number of intermediate positions, so that the control valve not only controls the direction in which the VCT phaser moves but, depending on the discrete spool position, controls the rate at which the VCT phaser changes positions. Therefore, it is understood that the phase control valve can also operate in infinite intermediate positions, and is not limited to the positions shown in the Figures.

Referring to FIGS. 12-18, a phase control valve 109, preferably a spool valve, includes a spool 111 with at least one cylindrical land 111*a* is slidably received in a sleeve 116 within a bore in the rotor assembly 105 and pilots in the camshaft (not shown). The phase control valve 109 may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators. Between the end of the spool 111 which contacts the spring 115 and the inner diameter 116*a* of the sleeve 116 is formed a pump chamber 150. The pump chamber 150 stores supply oil and the pressure of the oil in this chamber 150 is increased in pressure by the movement of the spool 111.

The position of the phase control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser.

A first pilot valve 230, preferably a spool valve, includes a spool 231 with cylindrical lands 231*a*, 231*b* slidably received in a sleeve 232 within a bore in the rotor assembly 105. The first pilot valve 230 may be located remotely from the phaser, or within a bore in the rotor assembly 105, which pilots in the camshaft (not shown). One end of the spool 231 contacts spring 233 and the opposite end of the spool 231 is in fluid communication with supply S through line 118. The supply line 11 may contain an inlet check valve 119 allowing for the flow of fluid into supply line 118 and preventing the flow of fluid out of supply line 118. The first pilot valve 230 is in fluid communication with the phase control valve 109 through lines 236 and 142 as well as with the recess 127 of the housing assembly 100 through line 140. The first pilot valve 230 additionally is in fluid communication with a supply line 234. Supply line 234 is preferably in fluid communication with supply S. Supply 234 could also be in fluid communication directly with line 118 or in communication selectively through the spool valve 109, such as a spool controlled lock pin circuit described in further detail below. Alternatively, supply 234 could be controlled by the advance chamber 102 or the retard chamber 103. A vent port 235 is also present within the sleeve 232 of the first pilot valve 230. The position of the first pilot valve 230 determines which circuit is connected to the lock pin: spool controlled lock pin circuit or the pump chamber circuit. In other words, the first pilot valve 230 determines which of the two lock pin control circuits is connected to the lock pin.

A second pilot valve 240, preferably a spool valve, includes a spool 241 with cylindrical lands 241*a*, 241*b* slidably received in a sleeve 242 within a bore in the rotor assembly 105. The second pilot valve 240 may be located remotely from the phaser, or within a bore in the rotor assembly 105, which pilots in the camshaft (not shown). One end of the spool 241 contacts spring 243 and the opposite end of the spool 241 is in fluid communication with supply S through line 118. The second pilot valve 240 is in fluid communication with the phase control valve 109 through lines 246 and 142. The second pilot valve 240 additionally is in fluid communication with a vent 244. Supply line 118 is preferably in fluid communication with line 245 of the second pilot valve 240 and directly with line 118. A vent port 247 is also present within the sleeve 242 of the second pilot valve 240. The second pilot valve is not in direct fluid communication with the lock pin 125.

The position of the spool 111 is influenced by spring 115 and the variable force solenoid 107. The position of the spool 111 controls the spool controlled lock pin circuit and whether supply oil is provided to a pump chamber 150 present between the spool and the sleeve 116 with the second pilot valve 240. The first pilot valve 230 and the second pilot valve 240 each have two positions.

In a first position of the first pilot valve 230, spool land 231*b* blocks the flow of fluid from supply line 234 and in a second position, supply line 234 is open to receiving fluid from a supply, preferably from the spool controlled lock pin circuit and line 236 is blocked by spool land 231*a*. In the first position of the second pilot valve 240, spool land 241*b* blocks vent 244. In a second position of the second pilot valve 240, vent 244 is open and spool land 241*a* blocks supply line 245.

A spool controlled lock pin circuit is comprised of a supply line 234 in fluid communication with the first pilot valve 230, the first pilot valve 230, line 140 in fluid communication with the recess 127 of the housing assembly 100 and the lock pin 125. When the engine is off the lock pin 125 is in the locked position.

A pump chamber circuit is comprised of a supply line 118 in fluid communication with the first pilot valve 230 and the second pilot valve 240, the first pilot valve 230 and the second pilot valve 240, line 246 in fluid communication with, line 142 and the second pilot valve 240, line 236 in fluid communication with line 142 and the first pilot valve 230, the pump chamber 150, and line 142 in fluid communication with pump chamber 150 and the first and second pilot valves 230, 240. The pump chamber 150 fills by decaying oil pressure and fluid venting from the lock pin 125 and the first and second pilot valves 230, 240 until either the pressure is no longer sufficient to force fluid into the pump chamber 150 or the pump chamber 150 is full. Therefore, the pump chamber 150 is filled as engine oil pressure drops.

The pump chamber circuit is filled during engine off. Some of the fluid present in the phaser itself, with the exceptions of the advance and retard chambers of a CTA phaser, may drain back into the pump chamber 150. The primary method for filling of the pump chamber is the residual oil pressure Residual pressure from the oil system fills the pump chamber circuit until either the pressure is no longer sufficient to force fluid into the pump chamber 150 or the pump chamber 150 is full.

Typically, during engine cranking, after an engine shutdown, there is no oil pressure present to unlock the lock pin 125 and no phasing can begin until after the lock pin 125 has been pressure biased to an unlocked position. In the present invention, during engine cranking and/or start-up, after engine shutdown, the lock pin 125 is moved to an unlocked position when the pump chamber is in fluid communication with the lock pin 125 and the spool 111 is stroked. In other words, when fluid moves from the pump chamber 150, through line 142, between spool lands 231*a* and 231*b* of the first pilot valve 230 to the recess 127 through line 140, the lock pin 125 is moved against the force of the spring 124, such that the end 125*a* of the lock pin 125 no longer engages the recess 127.

Once the end 125*a* of the lock pin 125 has disengaged from the recess 127, the rotor assembly 105 can be moved relative to the housing assembly 100 and the phaser can be phased, for example to a retard position, an intermediate position, an advance position and in some phasers, a detent position. Fluid is supplied to the recess 127 of the lock pin 125 to maintain the lock pin 125 in the unlocked position from supply line 234 of the first pilot valve 230 when supply pressure is present and the phaser is phasing. At this point, no fluid is being, maintained in the pump chamber 150. Should the pump chamber circuit not be used to unlock the phaser the spool 111 can perform its normal function of unlocking the phaser after oil pressure reaches an operating level because the first pilot valve 230 will have moved up to vent the pump chamber 150 and connect passage 234 to passage 140. The second pilot valve 240 controls when supply oil S is connected to the pump chamber 150 to fill and when the pump chamber 150 is vented to allow the spool valve 109 to move freely.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively. The first and second pilot valves 230, 240 are pressurized and move to the second position when supply pressure is adequate, and the lock pin 125 will be pressurized and released.

Figure 12:
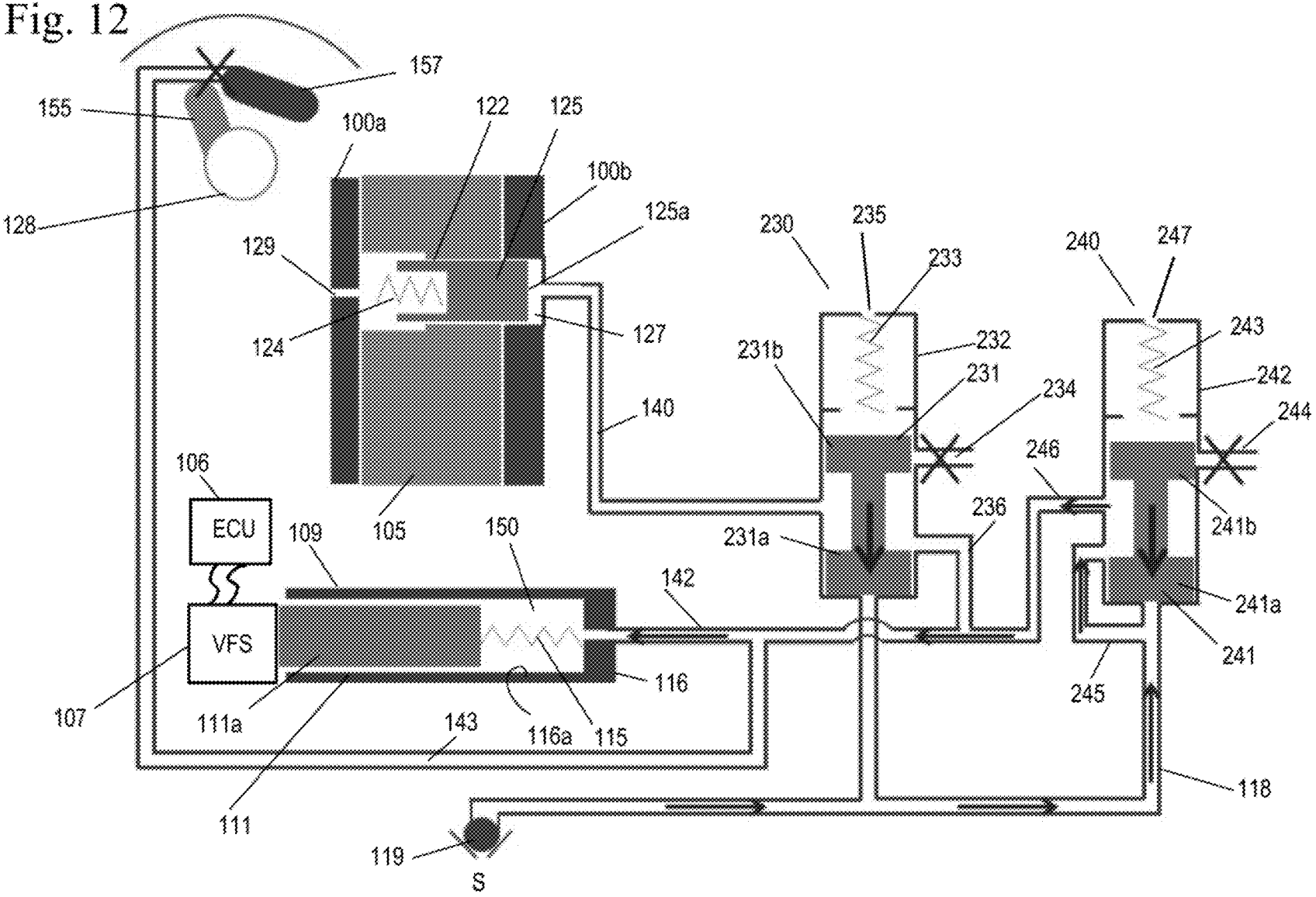
FIG. 12 shows a schematic of a variable cam timing phaser of another embodiment during shutdown of the phaser and filling of the spool chamber.

Referring to FIG. 12, when the duty cycle of the variable force solenoid 107 is 0%, the spool 111 of the phase control valve 109 is moved to a position by the spring 115, such that the pump chamber 150 receives any fluid present in the supply line 118 by passing through the second pilot valve 240 between lands 241*a* and 241*b* via line 245 to line 246 and the lock pin 125 can be pressurized and released via spool controlled lock pin circuit. From line 246, fluid flows to line 142 and to the pump chamber 150. Since the pressure of the fluid from supply S is below a threshold, due to engine shutdown, spring 233 biases the spool 231 of the first pilot valve 230 to a position such that the supply 234 is blocked from supplying fluid to the lock pin 125 via line 140. At the same time, due to the passage of fluid between lands 241*a* and 241*b* of the second pilot valve 240 and the spring force of spring 243, vent 244 is additionally blocked. Any fluid present in line 140 can drain to the pump chamber 150 via the first pilot valve 130 by passing through the first pilot valve 230 to line 236 and line 142. Due to the absence of fluid pressure in line 140, the lock pin 125 is biased by spring 124 to engage recess 127 and lock the relative movement of rotor assembly 105 relative to the housing assembly 100. The filling of the pump chamber 150 is essentially priming the phase control valve 109 to act as a pump. The volume of fluid, which aggregates in the fluid chamber 150, is preferably a volume in which would be required to unlock the lock pin 125, with provisions for leakage. The rotor pocket 157 is not aligned with the end plate pocket 155 and vent 128 is blocked.

Figure 13:
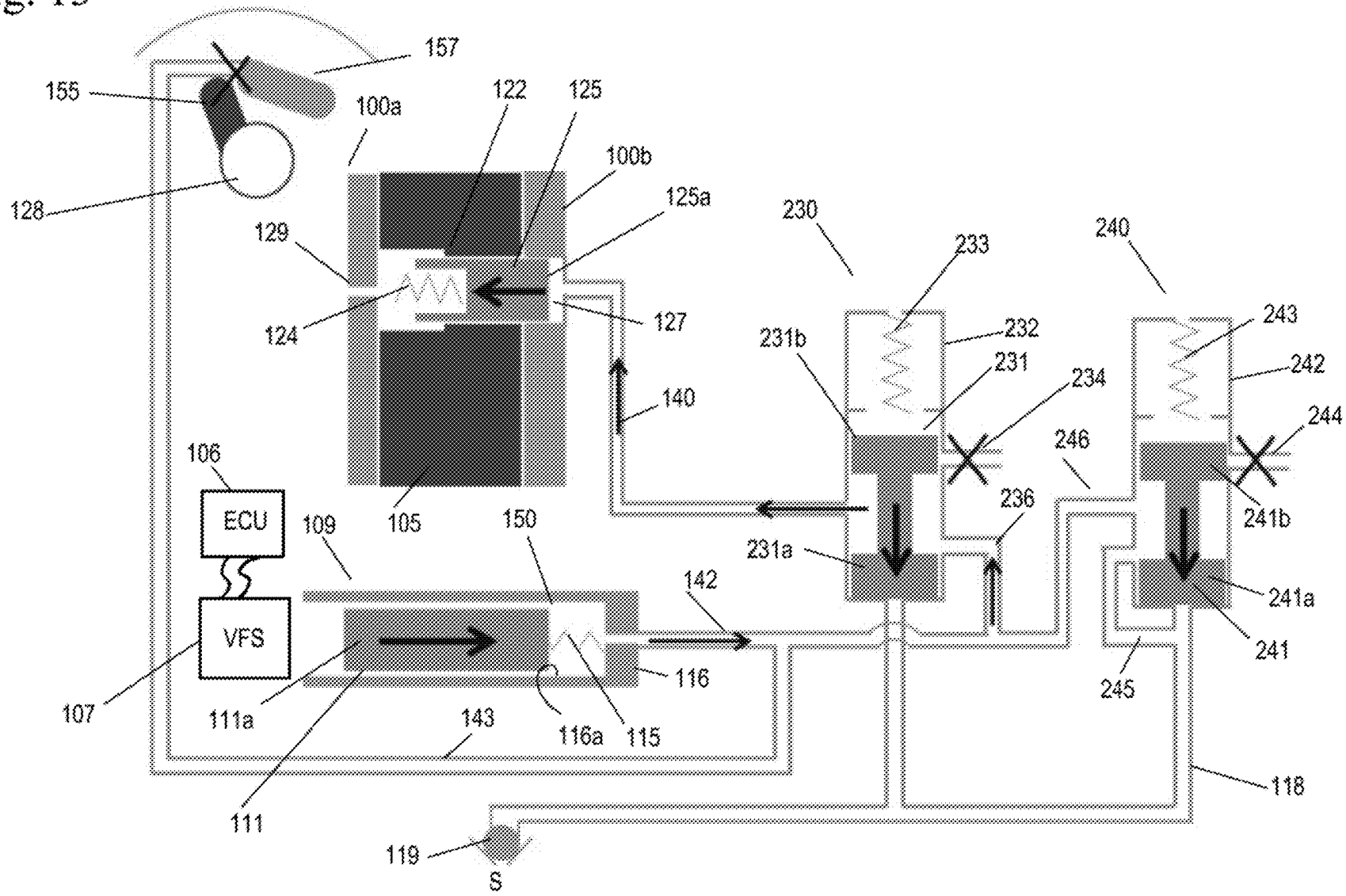
FIG. 13 shows a schematic of a variable cam timing phaser of another embodiment during operation of the spool pump.

FIG. 13 shows a schematic of a variable cam timing phaser of another embodiment during operation of the spool pump at engine cranking. During engine cranking there is very little to no pressure present due to the lack of supply oil pressure. Since no supply pressure is present both from supply line 118 and from line 234, there is no pressure present to unlock the lock pin 125 and thus phase the phaser soon after engine or during engine cranking.

During engine cranking, the spool 111 of the phase control valve 109 is moved to a position, by the VFS 107, against the force of the spring 115. During engine cranking, in order to pump the fluid from the pump chamber 150, the duty cycle starts at 0% and moves to 100%, to force the phase control valve 109 to expel the fluid present in the pump chamber 150 and exhaust from the pump chamber 150 into line 142. The movement of the spool by the VFS 107 against the three of the spring 115 creates pressure in the pump chamber 150, pumping or forcing the fluid into line 142 at a high pressure. From line 142, fluid flows between lands 231*a* and 231*b* of the first pilot valve 230 to line 140 in fluid communication with the recess 127 in the housing assembly 100, biasing the lock pin 125 against the spring 124 toward an unlocked position. The rotor pocket 157 is not aligned with the end plate pocket 155 and vent 128 is blocked.

Figure 14:
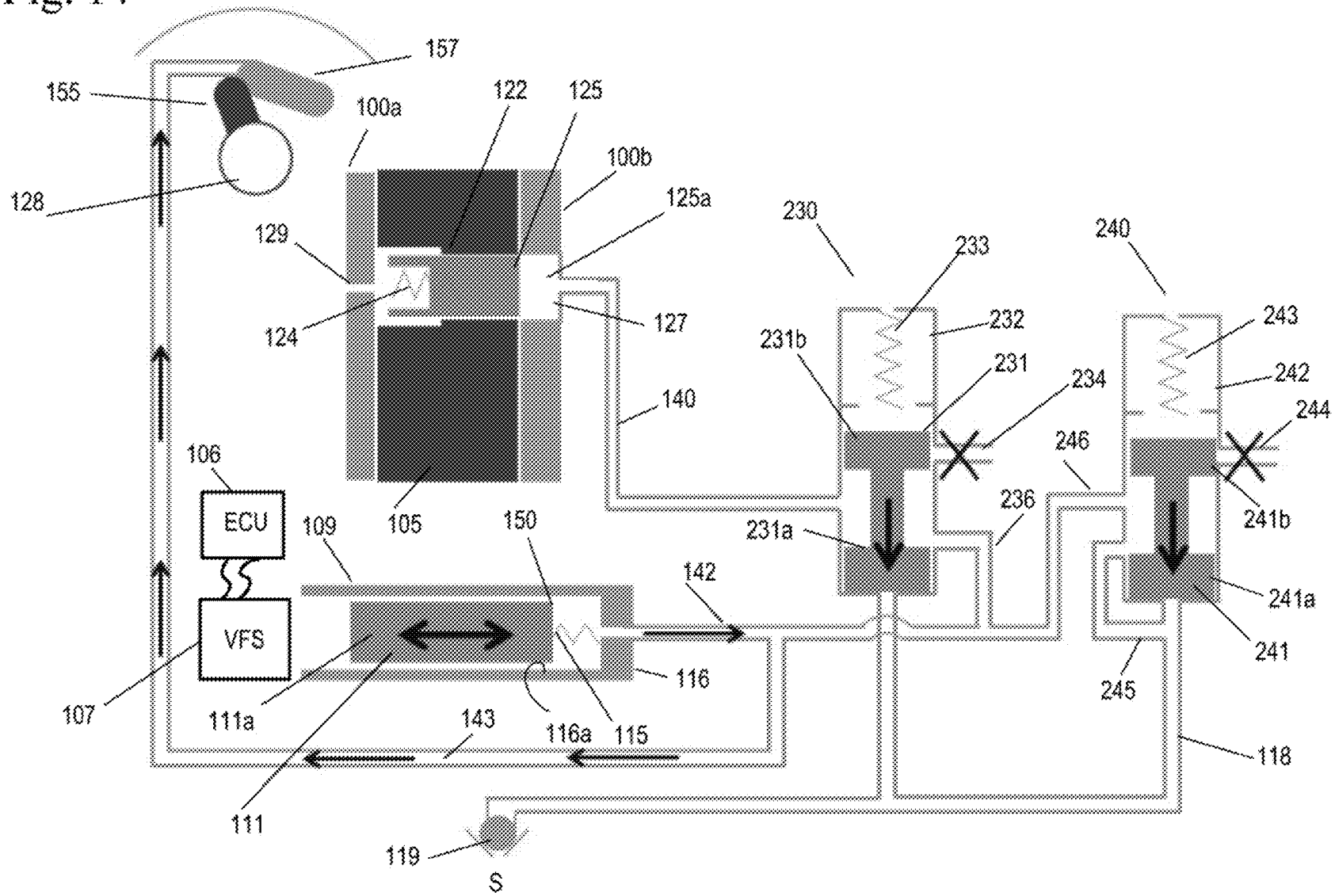
FIG. 14 shows a schematic of a variable cam timing phaser of another embodiment during venting of the pump circuit once the phaser has been phased away from a locked position.

FIG. 14 shows the phaser during engine cranking, but after the lock pin 125 has been moved to an unlocked position. It should be noted that the duty cycle is moved to whatever cycle is necessary for a target phasing of the variable cam timing phaser. After the lock pin 125 has been unlocked and no longer engages the recess 127 of the housing assembly 100, the rotor assembly 105 is free to rotate. Fluid exiting the pump chamber 150 exhausts to line 143 in communication with the vent 128, as the rotor pocket 157 is aligned with the end plate pocket 155, allowing the spool 111 to move and prevent lockup and allow the phaser to phase. Supply 234 is blocked from supplying fluid to the lock pin 125 by land 231*b* of the first pilot valve 230 and so that fluid is not allowed to travel back to supply 234. It should be noted that supply 234 is blocked, as the fluid pressure in supply line 118 is not adequate to bias the first pilot valve 230 (nor the second pilot valve 240) to a second position against spring 233, 243 (e.g. the oil pressure has not reached a threshold).

Figure 15:
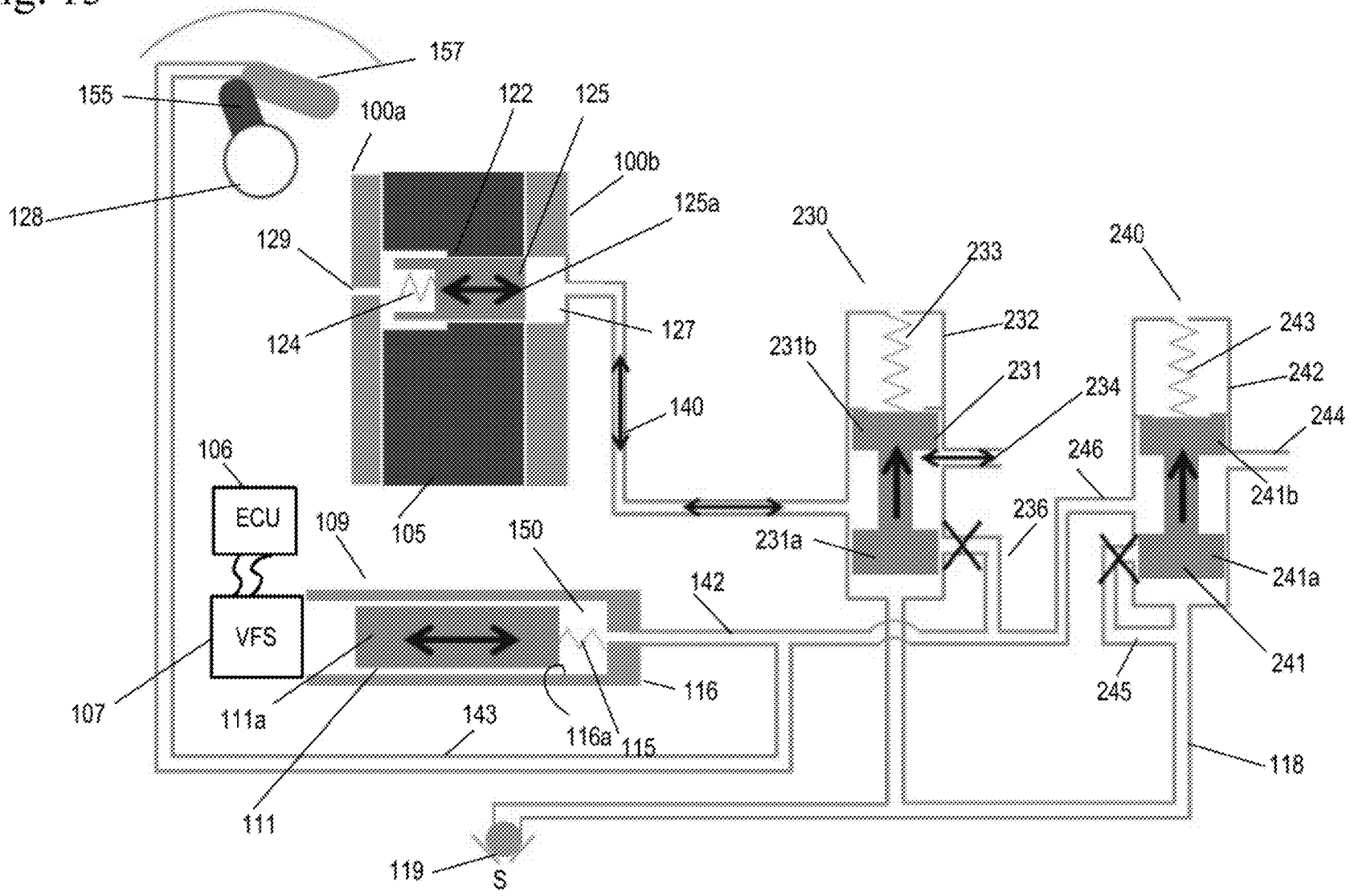
FIG. 15 shows a schematic of a variable cam timing phaser of another embodiment during normal operation once the engine is running and oil pressure has reached a threshold.
Figure 16:
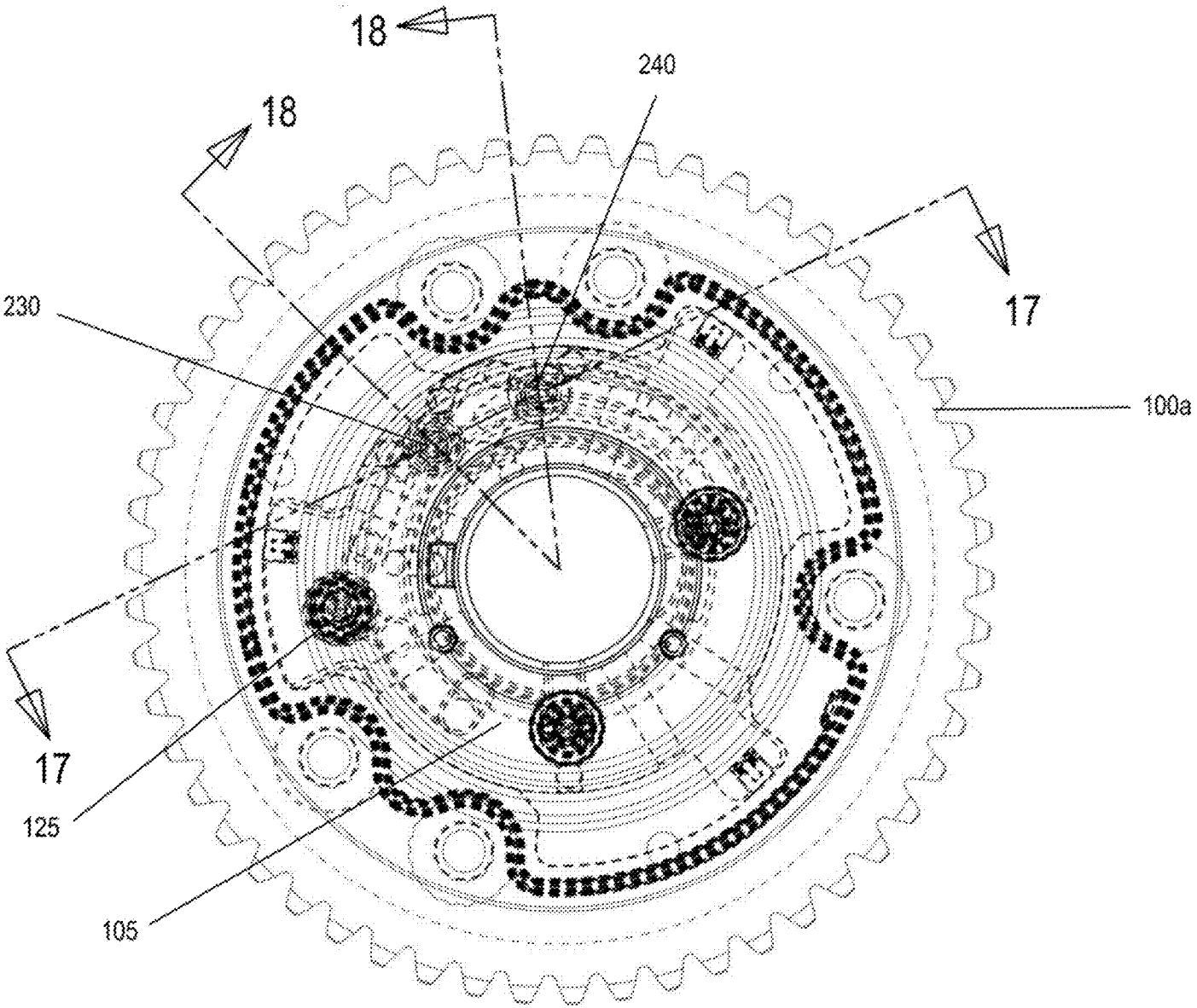
FIG. 16 shows a sectional view of variable cam timing phaser of another embodiment.
Figure 17:
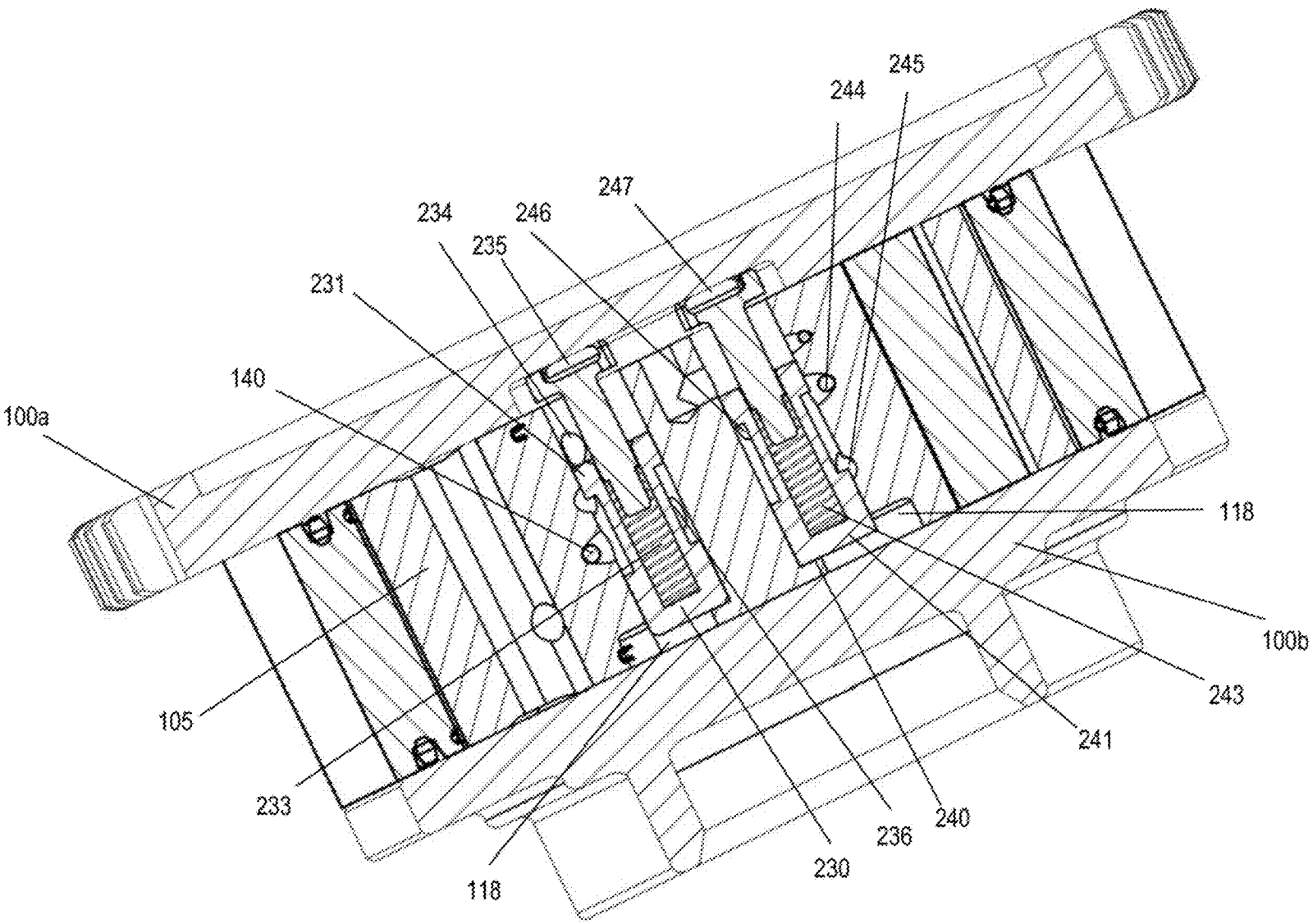
FIG. 17 shows a cross sectional view along line 17-17 of FIG. 16.
Figure 18:
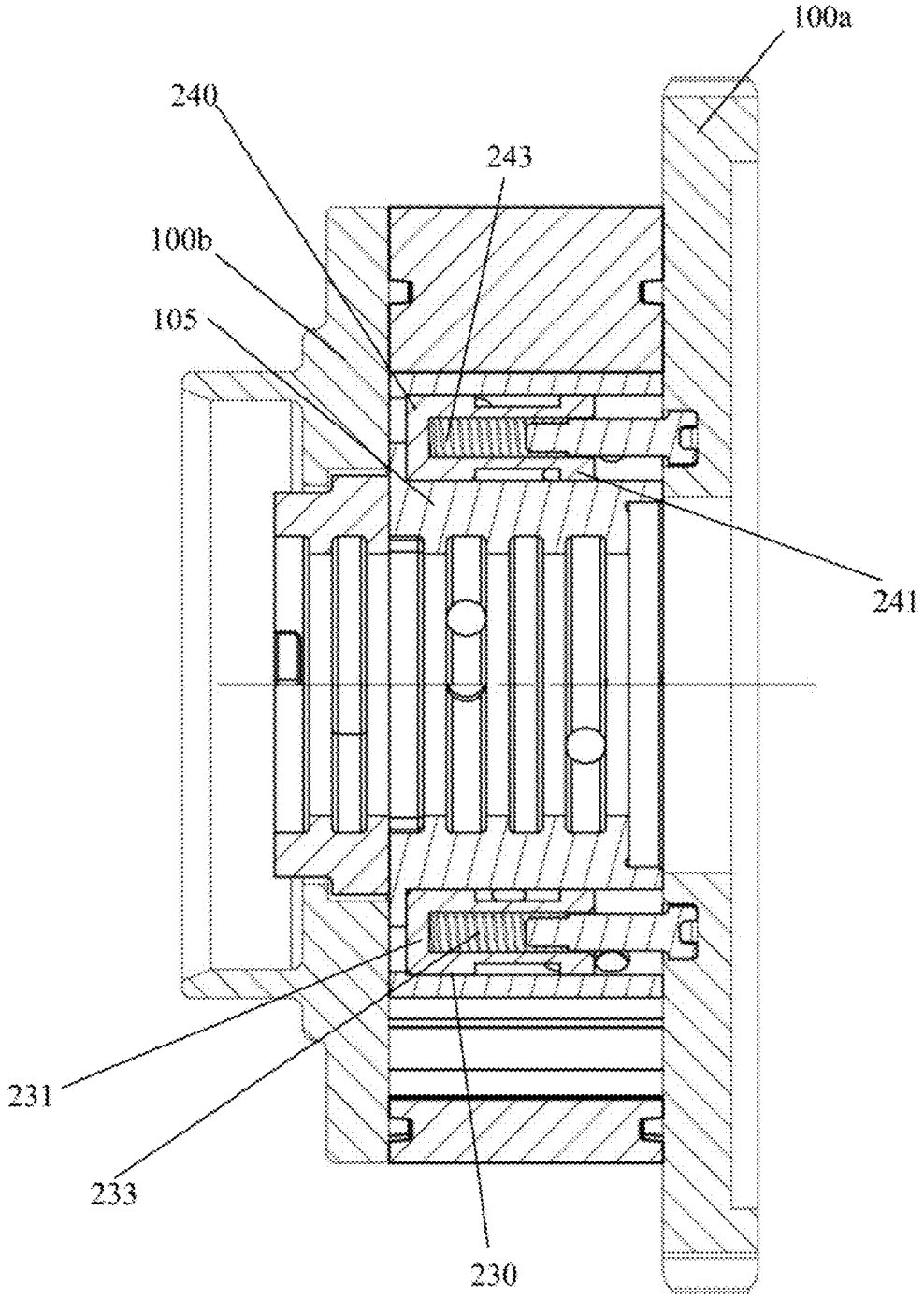
FIG. 18 shows another cross sectional view along line 18-18 of FIG. 16.

FIG. 15 shows a schematic of a variable cam timing phaser of an embodiment during normal operation once the engine is running and oil pressure has reached a threshold. Once the oil pressure in line 118 reaches a pressure in which it can bias the spools 231, 241 of the first and second pilot valves 230, 240 against the spring 233, 243 the spools 231, 241 are moved to a second position in which spool land 231*a* blocks line 236 and spool land 241*a* blocks line 245. Any fluid present in the pump chamber 150 of the phase control valve 109 is incidental and vents through vent 244 of the second pilot valve 240. Fluid is also supplied from supply 234, through the first pilot valve 230 between spool lands 231*a* and 231*b* to line 140, maintaining the lock pin 125 in an unlocked position and biasing the lock pin 125 against the spring 124. It should be noted that the lock pin 125 may remain in an unlocked state without fluid from supply 234 until the lock pin 125 is aligned with the recess 127. Normal engine operation may take place and the lock pin 125 may be moved to an unlocked position and a locked position per engine operation conditions. Furthermore, the rotor pocket 157 is aligned with the end plate pocket 155 and vent 128 is open.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine, the variable cam timing phaser comprising:

a housing assembly with an outer circumference configured to accept drive force, an outer end plate and an inner end plate;

a rotor assembly configured to connect to a camshaft, having a plurality of vanes coaxially located within the housing assembly, wherein the housing assembly and the rotor assembly define at least one chamber separated by a vane of the plurality of vanes into working fluid chambers, motion of the vane within the at least one chamber acting to shift a relative angular position of the housing assembly and the rotor assembly;

a lock pin slidably located in one of the rotor assembly or the housing assembly, the lock pin configured to move from an unlocked position in which an end portion of the lock pin does not engage a lock pin recess in a remaining one of the rotor assembly or the housing assembly, to a locked position in which the end portion of the lock pin engages the lock pin recess, locking the relative angular position of the housing assembly and the rotor assembly at a locked position;

a control valve configured to move between at least a first position and a second position, the control valve comprising: a spool slidably received within a sleeve having a pump chamber as to accumulate a volume of fluid defined between the spool and the sleeve;

a pilot valve in fluid communication with the lock pin, a supply and the control valve, the pilot valve having a first position in which fluid flows from the pump chamber to the lock pin recess and a second position in which the fluid flows from the supply to the lock pin recess;

wherein during engine shutdown, the fluid from the supply and/or the lock pin recess, flows through the pilot valve to the pump chamber in the control valve;

wherein during engine cranking, prior to a build up of fluid pressure to a threshold, the control valve moves from the first position to the second position so as to force the volume of fluid in the pump chamber to flow through the pilot valve to the lock pin recess so as to move the lock pin to an unlocked position.

2. The variable cam timing phaser of claim 1, wherein the pilot valve is in the rotor assembly.

3. The variable cam timing phaser of claim 1, wherein the pilot valve is located remotely from the variable cam timing phaser.

4. The variable cam timing phaser of claim 1, wherein the control valve is in the rotor assembly.

5. The variable cam timing phaser of claim 1, wherein the control valve is located remotely from the variable cam timing phaser.

6. The variable cam timing phaser of claim 1, wherein the volume of fluid is a volume of fluid configured to move the lock pin from an unlocked position to a locked position.

7. The variable cam timing phaser of claim 1, further comprising a rotor pocket in the rotor assembly and a housing pocket in the outer end plate in fluid communication with a vent.

8. The variable cam timing phaser of claim 7, wherein when the engine is cranking, the rotor pocket is aligned with the housing pocket and the vent, such that the fluid exhausts from the control valve so as to prevent control valve lock up.

9. The variable cam timing phaser of claim 1, wherein the fluid from the supply and/or the lock pin recess flows through the pilot valve to the pump chamber in the control valve until the pump chamber is full.

10. The variable cam timing phaser of claim 1, wherein the fluid from the supply and/or the lock pin recess flows through the pilot valve to the pump chamber in the control valve until fluid pressure within the variable cam timing phaser is not great enough to force the fluid into the pump chamber.

11. A variable cam timing phaser for an internal combustion engine, the variable cam timing phaser comprising:

a housing assembly with an outer circumference configured to accept drive force, an outer end plate and an inner end plate;

a rotor assembly configured to connect to a camshaft, having a plurality of vanes coaxially located within the housing assembly, wherein the housing assembly and the rotor assembly define at least one chamber separated by a vane of the plurality of vanes into working fluid chambers, motion of the vane within the at least one chamber acting to shift a relative angular position of the housing assembly and the rotor assembly;

a lock pin slidably located in one of the rotor assembly or the housing assembly, the lock pin configured to move from an unlocked position in which an end portion of the lock pin does not engage a lock pin recess in a remaining of the rotor assembly or the housing assembly, to a locked position in which the end portion of the lock pin engages the lock pin recess, locking the relative angular position of the housing assembly and the rotor assembly at a locked position;

a control valve configured to move between at least a first position and a second position, the control valve comprising: a spool slidably received within a sleeve having a pump chamber so as to accumulate a volume of fluid defined between the spool and the sleeve;

a first pilot valve in fluid communication with the lock pin, a supply and the control valve, the first pilot valve has a first position in which fluid flows from the pump chamber to the lock pin recess and a second position in which the fluid flows to and from the lock pin via a spool controlled lock pin circuit;

a second pilot valve in fluid communication with the supply, a vent, and the control valve, the second pilot valve has a first position in which the fluid flows from the supply to the pump chamber and a second position in which the fluid vents from the pump chamber;

wherein during engine shutdown, fluid from at least the supply flows through the second pilot valve to the pump chamber in the control valve;

wherein during engine cranking, prior to a build up of fluid pressure to a threshold, the control valve moves from the first position to the second position so as to force the volume of fluid in the pump chamber to flow through the first pilot valve to the lock pin recess so as to move the lock pin to an unlocked position.

12. The variable cam timing phaser of claim 11, wherein the first pilot valve and the second pilot valve are in the rotor assembly.

13. The variable cam timing phaser of claim 11, wherein the first pilot valve and the second pilot valve are located remotely from the variable cam timing phaser.

14. The variable cam timing phaser of claim 11, wherein the control valve is in the rotor assembly.

15. The variable cam timing phaser of claim 11, wherein the control valve is located remotely from the variable cam timing phaser.

16. The variable cam timing phaser of claim 11, wherein the volume of fluid is a volume of fluid configured to move the lock pin from an unlocked position to a locked position.

17. The variable cam timing phaser of claim 11, further comprising a rotor pocket in the rotor assembly and a housing pocket in the outer end plate in fluid communication with a vent.

18. The variable cam timing phaser of claim 17, wherein when the engine is cranking, the rotor pocket is aligned with the housing pocket and the vent, such that the fluid exhausts from the control valve so as to prevent control valve lock up.

19. The variable cam timing phaser of claim 11, wherein the fluid from the supply flows through the second pilot valve to the pump chamber in the control valve until the pump chamber is full.

20. The variable cam timing phaser of claim 11, wherein the fluid from the lock pin recess flows through the first pilot valve to the pump chamber in the control valve until the pump chamber is full.

21. The variable cam timing phaser of claim 11, wherein the fluid from the supply flows through the second pilot valve to the pump chamber in the control valve until fluid pressure within the variable cam timing phaser is not great enough to force the fluid into the pump chamber.

22. The variable cam timing phaser of claim 11, wherein the fluid from the lock pin recess flows through the first pilot valve to the pump chamber in the control valve until fluid pressure within the variable cam timing phaser is not great enough to force the fluid into the pump chamber.

* * * * *